US008389076B2

(12) United States Patent
Murakami et al.

(10) Patent No.: US 8,389,076 B2
(45) Date of Patent: Mar. 5, 2013

(54) PEELING MEMBER, MEMBER FOR FORMING PEELING MEMBER, METHOD OF MANUFACTURING PEELING MEMBER, IMAGE REMOVER, IMAGE FORMING AND REMOVING SYSTEM, AND IMAGE REMOVING METHOD

(75) Inventors: Kakuji Murakami, Kanagawa (JP); Masatoshi Saitoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 431 days.

(21) Appl. No.: 12/671,035

(22) PCT Filed: Sep. 11, 2008

(86) PCT No.: PCT/JP2008/066898

§ 371 (c)(1),
(2), (4) Date: Jan. 28, 2010

(87) PCT Pub. No.: WO2009/035135

PCT Pub. Date: Mar. 19, 2009

(65) Prior Publication Data

US 2010/0196630 A1 Aug. 5, 2010

(30) Foreign Application Priority Data

Sep. 14, 2007 (JP) ..... 2007-240081
May 12, 2008 (JP) ..... 2008-124531

(51) Int. Cl.
*B41M 5/40* (2006.01)

(52) U.S. Cl. ..... 428/32.39; 428/32.51; 156/235

(58) Field of Classification Search ..... 428/32.39, 428/32.51; 156/235
See application file for complete search history.

(56) References Cited

U.S. PATENT DOCUMENTS 4,330,194 A 5/1982 Murakami
(Continued)

FOREIGN PATENT DOCUMENTS

JP 7 13383 1/1995
JP 7 53493 2/1995
(Continued)

OTHER PUBLICATIONS

Machine Translation of JP 2000-338834.*
(Continued)

*Primary Examiner* — Gerard Higgins
*Assistant Examiner* — Sathavaram I Reddy
(74) *Attorney, Agent, or Firm* — Oblon, Spivak, McClelland, Maier & Neustadt, L.L.P.

(57) ABSTRACT

A peeling member to be used in an image remover configured to peel off and remove an image by thermal transfer from a recording material on which the image is formed of a thermoplastic image forming substance is disclosed that includes a base body; a rubber elasticity layer provided on the base body, the rubber elasticity layer being formed of a material having rubber elasticity; an organic polymer compound layer provided on the rubber elasticity layer, the organic polymer compound layer presenting no plasticity at a heating temperature for peeling off and removing the image on the recording material by the thermal transfer and having a Young fs modulus of 400 MPa to 6000 MPa at normal temperature; and a thermoplastic composition layer formed on the surface of the organic polymer compound layer so as to serve as an outermost surface layer presenting adhesion to the thermoplastic image forming substance.

11 Claims, 9 Drawing Sheets

U.S. PATENT DOCUMENTS

| | | | |
|---|---|---|---|
| 5,534,063 | A | 7/1996 | Maruyama et al. |
| 5,607,534 | A | 3/1997 | Kawanishi et al. |
| 5,619,765 | A | 4/1997 | Tokita et al. |
| 5,638,842 | A | 6/1997 | Tokita et al. |
| 5,643,380 | A | 7/1997 | Saitoh et al. |
| 5,736,286 | A | 4/1998 | Kaneko et al. |
| 5,769,957 | A | 6/1998 | Murakami et al. |
| 5,782,254 | A | 7/1998 | Tanikawa et al. |
| 5,968,301 | A | 10/1999 | Murakami et al. |
| 6,076,218 | A | 6/2000 | Taniguchi et al. |
| 6,439,713 | B1 | 8/2002 | Noguchi et al. |
| 6,623,816 | B1 | 9/2003 | Tanikawa et al. |
| 6,837,578 | B2 | 1/2005 | Tanikawa et al. |
| 7,070,269 | B2 | 7/2006 | Tanikawa et al. |
| 7,283,758 | B2 | 10/2007 | Murakami |
| 2006/0062997 | A1 | 3/2006 | Murakami |

FOREIGN PATENT DOCUMENTS

| | | |
|---|---|---|
| JP | 7 92868 | 4/1995 |
| JP | 2584112 | 11/1996 |
| JP | 9 204060 | 8/1997 |
| JP | 9 204061 | 8/1997 |
| JP | 9 230761 | 9/1997 |
| JP | 10 74025 | 3/1998 |
| JP | 10 288928 | 10/1998 |
| JP | 2958772 | 7/1999 |
| JP | 11 219073 | 8/1999 |
| JP | 2000 338834 | 12/2000 |
| JP | 200166957 | 3/2001 |
| JP | 2002 72792 | 3/2002 |

OTHER PUBLICATIONS

Machine Translation of JP 2003-248382.*

Machine Translation of JP 2005-257762.*

U.S. Appl. No. 08/643,456, filed May 8, 1996, Kaneko, et al.

U.S. Appl. No. 08/944,198, filed Oct. 3, 1997, Fujita, et al.

U.S. Appl. No. 08/754,692, filed Nov. 21, 1996, Unknown.

* cited by examiner

PEELING MEMBER, MEMBER FOR FORMING PEELING MEMBER, METHOD OF MANUFACTURING PEELING MEMBER, IMAGE REMOVER, IMAGE FORMING AND REMOVING SYSTEM, AND IMAGE REMOVING METHOD

TECHNICAL FIELD

The present invention relates to, for example, a peeling member for peeling off and removing an image by thermal transfer, the image being formed of a thermoplastic image forming substance on recording material by an image forming apparatus such as a copier, printer, or a facsimile machine; a member for forming the peeling member; a method of manufacturing the peeling member; an image remover having the peeling member; an image forming and removing system; and a method of removing an image.

BACKGROUND ART

In these years, a large amount of paper as recording material on which images are to be formed has been consumed because electrophotographic image forming apparatuses such as copiers, printers, and facsimile machines have become widely used. Here, paper used as recording material is made from wood pulp as a raw material. Therefore, in terms of the global environment, it has been an important social issue to protect forests by reducing paper consumption and preventing a decrease in forests due to logging.

Further, since paper includes incombustible or non-decomposable inorganic components, wasted materials that require the use of landfills are generated at a certain ratio when paper is discarded. In these years, however, it has become difficult to newly reserve landfills, so that also in terms of waste reduction, it remains a social issue to reduce paper consumption.

Therefore, conventionally, in order to deal with these issues, paper once used is collected instead of being discarded as trash, and the collected wastepaper is first defibrated into pulp in a paper mill and is reused as recycled paper. There are many problems, however, in the process of collecting wastepaper and turning it into recycled paper, such as the possibility of leakage of corporate classified papers or data at the time of collecting wastepaper, time and effort for sorting wastepaper by paper type, and degradation of the pulp quality of re-pulped wastepaper.

Therefore, in order to solve these problems, techniques have been proposed in these years that enable recording material to be reusable by peeling off and removing an image on the recording material. (See, for example, Patent Documents 1, 2, 3, and 4 listed below.)

Patent Document 1 describes the technique of peeling off and removing a thermoflexible image forming substance of an image formed on paper by electrophotography by impregnating the paper with a liquid including water to reduce the adhesion between the paper and the image forming substance and causing the paper and a peeling roller serving as a peeling member to come into heated press contact.

Patent Document 2 describes an apparatus for removing an image formed on recording material by transferring and peeling off the image by using an endless peeling belt having a hot-melt resin layer at its surface and applying heat and pressure to the recording material placed on top of the surface of the peeling belt.

Patent Documents 3 and 4 each describe an image remover that uses a roller-shaped peeling member that includes a silicone rubber layer provided on the surface of a metal core bar and a thermoplastic resin layer provided on this silicone rubber layer.

[Patent Document 1] Japanese Laid-Open Patent Application No. 7-13383

[Patent Document 2] Japanese Patent No. 2584112 (Japanese Laid-Open Patent Application No. 4-64472)

[Patent Document 3] Japanese Laid-Open Patent Application No. 2002-72792

[Patent Document 4] Japanese Laid-Open Patent Application No. 2001-66957

Patent Document 1 uses a rubber roller as a peeling roller, and the rubber roller is formed of a material commonly used as rubber, such as natural rubber, chloroprene rubber, isoprene rubber, styrene-isoprene rubber, or silicone rubber. However, these rubber materials are low in adhesion to toner, which is a thermoplastic image forming substance, so that the image on the recording material cannot be completely removed. Further, in the case of applying an image removal accelerating liquid including water to the recording material, the image may be removed to some extent with the rubber roller because the adhesion between the image and the paper is reduced. However, it is difficult to remove a low-density gradation image.

Further, there is a problem in that even when reusable recording material is formed by adding a composition that reduces adhesion to an image forming substance to the recording material to be used, and an attempt is made to remove an image formed on the reusable recording material by thermal transfer, which does not employ an image removal accelerating liquid, the image on the recording material can hardly be removed if the recording material is formed so as to present an image fixing characteristic sufficient for practical use, because the adhesion of the image forming substance to the rubber material becomes lower than the adhesion of the image forming substance to the recording material.

Further, if metal or a plastic film without a thermoplastic resin surface layer is employed as a peeling member, it is difficult to remove an image forming substance in concave parts at a paper surface. In particular, it is difficult to completely remove image forming substance particles that form background fogging and adhere alone or a low-density image. In particular, unlike a monochrome image, a color image also includes a secondary color and a tertiary color. Therefore, the height of the image is stepped. If there is a "high" image of a secondary color around a "low" image such as a monochromatic gradation image, it is difficult for the peeling member to come into contact with the "low" image. This causes the image forming substance to remain in the stepped image.

In general, in color images, heat fusing is performed until the surface of the image forming substance becomes continuously flat on the surface of the recording material in order to increase chroma. Therefore, even when an image removal accelerating liquid is applied from the surface of the image, the image removal accelerating liquid is blocked by the image forming substance and is prevented from reaching the cellulose fibers of the paper, thus making it difficult to remove the image.

Further, according to Patent Document 1, the image removal accelerating liquid including water is applied to the recording material. However, even if the amount of the liquid applied is only a little, repeated use of the recording material causes problems such as generation of wrinkles or curl and occurrence of a conveyance jam due to the generation of curl at the time of processing in an image forming apparatus or image remover. Thus, the number of times the recording material can be repeatedly used cannot be increased. Further, adding a large amount of the liquid causes problems such as the need for a large amount of energy to dry the absorbed liquid and a change in the size of the recycled recording material.

According to Patent Document 2, a thermoplastic or heat-melt resin layer is provided on the surface of a peeling member, and the surface of the peeling member and recording material are placed on top of each other to be subjected to heating and pressing. As a result, the surface of the peeling member deforms in accordance with the unevenness of an image on the recording material, so that the peeling member and the image are in good contact, thus improving the image removal characteristic. However, it is difficult to completely remove the image even with a peeling member (peeling belt) where a heat-melt resin is provided on an endless belt of metal or a heat-resistant organic polymer material such as a polyimide film. In particular, in the case of forming a color image including a secondary color and a tertiary color on the recording material, multiple layers of the image forming substance are formed, and it is difficult to remove a "low" low-density image around a multi-layer "high" image or the image forming substance that has been scattered around the image at the time of the transfer of the image to the recording material.

Further, there are also problems in the case of using an endless belt (peeling belt) as a peeling member. For example, if the peeling belt deviates to one side because of its continuous use, it is difficult to correct the deviation. If the deviation is forcibly corrected, an uneven tension is exerted on the peeling belt in its widthwise directions, so as to cause deformation of the peeling belt and reduction of its useful service life. In particular, if a cleaning part is provided for removing the image forming substance transferred from the recording material onto the peeling belt, at least two nips, one for transferring the image forming substance of the recording material onto the peeling belt and the other between the cleaning part and the peeing belt, are formed. This makes it extremely difficult to solve the problem of the deviation of the peeling belt.

A peeling member having such a configuration as described in Patent Document 3 or Patent Document 4 has the problem of low adhesion between the rubber layer and the thermoplastic layer. Therefore, there is a problem in that if recording material having an adhesion (fixing) characteristic sufficient for practical use with respect to the image forming substance is used, the image forming substance on the recording material cannot be completely removed or the thermoplastic layer on the recording material is peeled off from the rubber layer so as to be transferred in reverse onto the recording material.

Further, there is a problem in the case of using recording material having low adhesion to the image forming substance. In this case, the image forming substance on the recording material can be removed at first. However, since the molecules of the rubber-like composition can move relatively freely as a characteristic of the rubber-like composition, a component of the thermoplastic resin layer provided on the rubber elasticity layer or a component of the image forming substance transferred onto the thermoplastic resin layer is mixed into the rubber elasticity layer, so that continuous use causes the rubber elasticity layer to swell and deform or makes it impossible to remove the image forming substance from the recording material.

DISCLOSURE OF THE INVENTION

Embodiments of the present invention may solve or reduce one or more of the above-described problems.

According to one embodiment of the present invention, there are provided a peeling member in which one or more of the above-described problems may be solved or reduced, a member for forming the peeling member, a method of manufacturing the peeling member, an image remover including the peeling member, an image forming and removing system including the image remover, and an image removing method using the peeling member.

According to one embodiment of the present invention, there are provided a peeling member, a member for forming the peeling member, a method of manufacturing the peeling member, an image remover including the peeling member, an image forming and removing system including the image remover, and an image removing method using the peeling member that have a good characteristic of removing an image (image forming substance) formed on recording material; can even remove a low-density image and an image forming substance forming background fogging; and in particular, can completely remove an image (image forming substance) formed on recording material even in the case of using recording material having relatively high adhesion to the image forming substance and an image fixing characteristic sufficient for practical use.

According to one embodiment of the present invention, there are provided a peeling member, a member for forming the peeling member, a method of manufacturing the peeling member, an image remover including the peeling member, an image forming and removing system including the image remover, and an image removing method using the peeling member that have a good characteristic of separating a peeling member and recording material at the time of removing an image (image forming substance) formed on the recording material by thermally transferring the image onto the peeling member; and in particular, have a good characteristic of separating a peeling member and recording material even in the case of using recording material having relatively high adhesion to the image forming substance and an image fixing characteristic sufficient for practical use.

According to one embodiment of the present invention, there are provided an image remover having a simple configuration and a reduced size, and a peeling member used in the image remover.

According to one embodiment of the present invention, there are provided a peeling member, a member for forming the peeling member, a method of manufacturing the peeling member, an image remover including the peeling member, an image forming and removing system including the image remover, and an image removing method using the peeling member that can remove an image from recording material with good reproducibility even in the case of long-term or continuous use.

According to one embodiment of the present invention, the useful service life of a peeling member is prolonged so that the peeling member can reduce the environmental impact and cost required to remove an image from recording material on which the image is formed, and there are also provided a member for forming the peeling member, a method of manufacturing the peeling member, an image remover including the peeling member, an image forming and removing system including the image remover, and an image removing method using the peeling member that can reduce the environmental impact and cost required to remove an image from recording material on which the image is formed because of the prolonged useful service life of the peeling member.

According to one embodiment of the present invention, a peeling member to be used in an image remover configured to peel off and remove an image by thermal transfer from a recording material on which the image is formed of a thermoplastic image forming substance is provided that includes a base body; a rubber elasticity layer provided on the base body, the rubber elasticity layer being formed of a material having rubber elasticity; an organic polymer compound layer provided on the rubber elasticity layer, the organic polymer compound layer presenting no plasticity at a heating temperature for peeling off and removing the image on the recording material by the thermal transfer and having a Young's modulus of 400 MPa to 6000 MPa at normal temperature; and a thermoplastic composition layer formed on a surface of the organic polymer compound layer so as to serve as an outermost surface layer presenting adhesion to the thermoplastic image forming substance.

According to one embodiment of the present invention, a member for forming a peeling member to be used in an image remover configured to peel off and remove an image by thermal transfer from a recording material on which the image is formed of a thermoplastic image forming substance is provided that includes a base body; a rubber elasticity layer provided on the base body, the rubber elasticity layer being formed of a material having rubber elasticity; and an organic polymer compound layer provided on the rubber elasticity layer, the organic polymer compound layer presenting no plasticity at a heating temperature for peeling off and removing the image on the recording material by the thermal transfer and having a Young's modulus of 400 MPa to 6000 MPa at normal temperature.

According to one embodiment of the present invention, a method of forming a peeling member to be used in an image remover configured to peel off and remove an image by thermal transfer from a recording material on which the image is formed of a thermoplastic image forming substance is provided that includes the steps of causing a thermoplastic composition to adhere to a surface of one of a web-shaped material and a sheet-shaped material; and thermally transferring the thermoplastic composition from the surface of the one of the web-shaped material and the sheet-shaped material to the above-described member for forming the peeling member.

According to one embodiment of the present invention, a method of forming a peeling member to be used in an image remover configured to peel off and remove an image by thermal transfer from a recording material on which the image is formed of a thermoplastic image forming substance is provided that includes the steps of fixing a thermoplastic composition onto a surface of one of a web-shaped member and a sheet-shaped member in a first unit, the web-shaped member and the sheet-shaped member each presenting releasability; and thermally transferring the thermoplastic composition from the one of the web-shaped member and the sheet-shaped member having the thermoplastic composition fixed to the surface thereof in the first unit to the above-described member for forming the peeling member.

According to one embodiment of the present invention, an image remover configured to peel off and remove an image by thermal transfer from a recording material on which the image is formed of a thermoplastic image forming substance is provided that includes the above-described peeling member, the peeling member being rotatably provided; a pressure member provided in contact with the peeling member so as to form a nip through which the recording material passes between the pressure member and the peeling member; a heating part configured to heat and soften the thermoplastic image forming substance on the recording material passing through the nip and the thermoplastic composition layer of the peeling member, thereby causing the thermoplastic image forming substance to adhere to a surface of the peeling member; and a separation member configured to separate the recording material that has passed through the nip from the surface of the peeling member.

According to one embodiment of the present invention, an image remover configured to peel off and remove an image by thermal transfer from a recording material on which the image is formed of a thermoplastic image forming substance is provided that includes a rotatable peeling member manufactured by either one of the above-described methods; a pressure member provided in contact with the peeling member so as to form a nip through which the recording material passes between the pressure member and the peeling member; a heating part configured to heat and soften the thermoplastic image forming substance on the recording material passing through the nip and the thermoplastic composition layer of the peeling member, thereby causing the thermoplastic image forming substance to adhere to a surface of the peeling member; and a separation member configured to separate the recording material that has passed through the nip from the surface of the peeling member.

According to one embodiment of the present invention, an image remover configured to peel off and remove an image by thermal transfer from a recording material on which the image is formed of a thermoplastic image forming substance is provided that includes the above-described member for forming a peeling member; a pressure member provided in contact with the member for forming the peeling member so as to form a nip through which the recording material passes between the pressure member and the member for forming the peeling member; a heating part configured to heat and soften the thermoplastic image forming substance on the recording material passing through the nip and the member for forming the peeling member; and a separation member configured to separate the recording material that has passed through the nip from a surface of the member for forming the peeling member, wherein, before removing the image, one of a web-shaped member and a sheet-shaped member having a thermoplastic composition fixed to a surface thereof is caused to pass through the nip so that the thermoplastic composition is thermally transferred to the surface of the member for forming the peeling member with the heating part, thereby forming a thermoplastic composition layer on the surface of the member for forming the peeling member.

According to one embodiment of the present invention, a method of removing an image by thermal transfer from a recording material on which the image is formed of a thermoplastic image forming substance is provided that includes the steps of causing the thermoplastic image forming substance to adhere to a surface of a rotatable peeling member by heating and softening the thermoplastic composition on the recording material passing through a nip between the peeling member and a pressure member and a thermoplastic composition layer at a surface of the peeling member with a heating part while causing the recording material to pass through the nip, the pressure member being in press contact with the peeling member; and separating the recording material that has passed through the nip from the surface of the peeling member with a separation member, wherein the peeling member is the above-described peeling member.

According to one embodiment of the present invention, an image forming and removing system is provided that includes an image forming apparatus configured to form an image of a thermoplastic image forming substance on a recording material; and an image remover configured to peel off and remove, by thermal transfer, the image of the thermoplastic image forming substance formed on the recording material by the image forming apparatus, wherein the image remover is any of the above-described image removers.

A peeling member according to one embodiment of the present invention includes an organic polymer compound layer on a rubber elasticity layer provided on a base body, the organic polymer compound layer presenting no plasticity at a heating temperature for peeling off and removing an image formed of a thermoplastic image forming substance on recording material and having a Young's modulus of 400 MPa to 6000 MPa at normal temperature; and a thermoplastic composition layer including thermoplastic resin, the thermoplastic composition layer being formed on the surface of the organic polymer compound layer and serving as an outermost surface layer to present adhesion to the thermoplastic image forming substance. Accordingly, by performing image removal with an image remover or an image forming and removing system having this peeling member, the outermost thermoplastic composition layer of the peeling member is heated and softened so as to suitably adhere to the image on the surface of the recording material.

Therefore, even if the image is "high" or there is large unevenness on the surface of the recording material as in the case of a color image formed by superposing image forming substances of multiple colors on the recording material, the thermoplastic composition layer satisfactorily comes into contact with the entire uneven image surface and the thermoplastic image forming substance adhering to the background, so that it is possible to ensure removal of the thermoplastic image forming substance on the recording material.

If a peeling member having the thermoplastic composition layer provided directly on the rubber elasticity layer is employed, the recording material periodically rises from the peeling member immediately after passing through the heat and pressure nip of the image remover. The cohesion failure occurs where the recording material is separated (detached) from the peeling member immediately after passing through the heat and pressure nip. Therefore, a periodic residual image is generated on the recording material subjected to the image removal processing. However, by providing the organic polymer compound layer having a Young's modulus substantially higher than that of the rubber elasticity layer and having flexibility between the rubber elasticity layer and the thermoplastic composition layer as in an embodiment of the present invention, the above-described rising is prevented from occurring, so that it is possible to completely remove the image.

Further, with the organic polymer compound layer, it is possible to prevent a component of the thermoplastic composition layer formed on the surface of the organic polymer compound layer from being transferred to the rubber elasticity layer. Therefore, even if the same peeling member is used for a long term, there is little change in the physical properties of the rubber elasticity layer, such as the modulus of elasticity. Accordingly, it is possible to repeatedly remove the image formed on the recording material stably and completely.

Further, according to one embodiment of the present invention, the rubber elasticity layer employed may have a relatively large thickness. Therefore, it is possible to ensure a sufficiently large nip width even in the case of using a rigid body such as metal as the pressure member opposed to the peeling member.

Further, the heating part may be provided inside the pressure member so that the pressure member may be used as a heat and pressure member. This facilitates heat conduction to the recording material in the nip, thus making it possible to perform image removal at high speed. Further, since the rubber elasticity layer and the organic polymer compound layer are extremely lower in thermal conductivity than metal material, heat is less easily conductible to the base body side across the rubber elasticity layer, so that the temperature increases only at and near the surface of the peeling member inside the nip formed by the peeling member and the heat and pressure member. That is, since the temperature increases only where the heat capacity is low, the temperature of the peeling member and the thermoplastic image forming substance adhering to the peeling member is easily reducible in a process after passing through the nip.

Therefore, when the recording material is separated from the peeling member, the temperature of the thermoplastic image forming substance on the recording material and the thermoplastic composition layer of the peeling member has been rapidly reduced, so that it is possible to prevent cohesion failure from occurring in the thermoplastic image forming substance on the recording material and the thermoplastic composition layer of the peeling member to cause the thermoplastic image forming substance to remain on the recording material or transfer in reverse the thermoplastic composition layer of the peeling member to the recording material.

Further, if the peeling member is provided with a relatively thick rubber elasticity layer, and a roller member having high rigidity, such as a metal roller member, is employed as the pressure member opposed to the peeling member to form the nip, the recording material that has passed through the nip is disposed to be conveyed along the peripheral surface of the highly rigid roller member (pressure member). Because of this disposition, the recording material conveyed for image removal acts to be apart from the peeling member after passing through the nip, thus resulting in satisfactory separation of the recording material and the peeling member.

Further, according to a method of manufacturing a peeling member according to one embodiment of the present invention, the peeling member can be manufactured with ease at low cost.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description is given below, with reference to the accompanying drawings, of embodiments of the present invention.

First Embodiment

Figure 1:
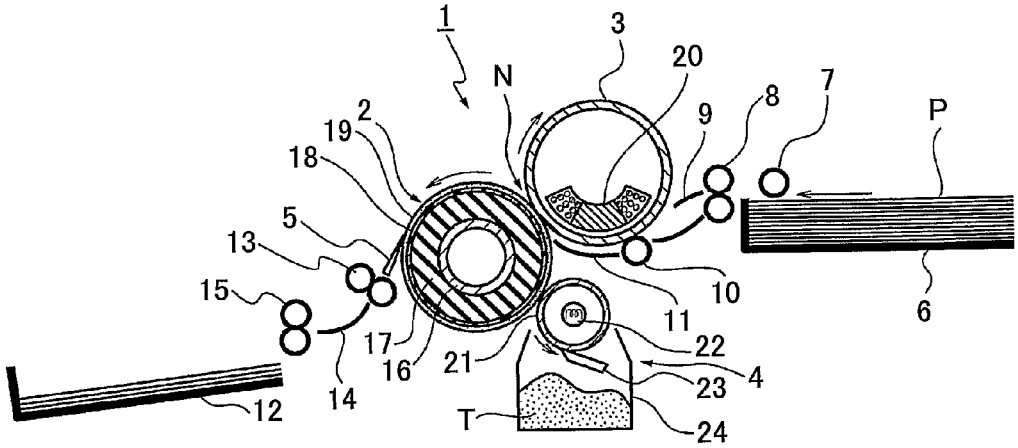
FIG. 1 is a diagram illustrating an image remover including a peeling roller as a peeling member according to a first embodiment of the present invention.

FIG. 1 is a diagram showing an image remover 1 including a peeling roller 2 as a peeling member according to a first embodiment of the present invention.

Figure 2:
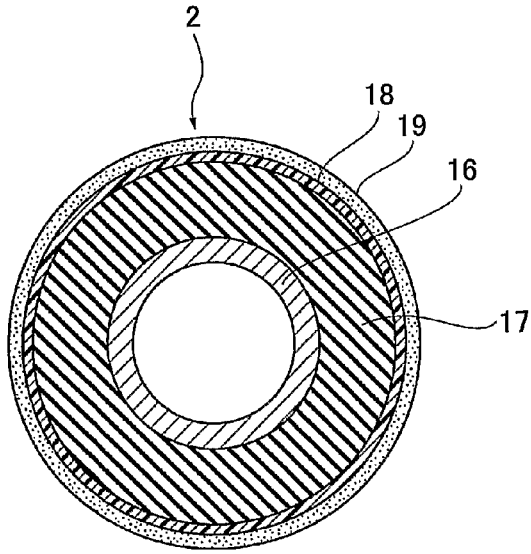
FIG. 2 is a cross-sectional view of the peeling roller according to the first embodiment of the present invention.

FIG. 2 is a cross-sectional view of the peeling roller 2.

According to this embodiment, the image remover 1 is a unit or apparatus that removes a thermoplastic image forming substance (hereinafter, "image forming substance") forming an image from recording material (recording medium) having the image formed thereon, thereby removing or erasing the image from the recording material, in an image forming apparatus such as a copier, printer, or facsimile machine.

Referring to FIG. 1, the image remover 1 according to this embodiment includes the peeling roller 2 rotatably supported to serve as a peeling member; a heat and pressure roller 3 rotatably supported in contact with the peeling roller 2 so as to serve as a pressure member, the heat and pressure roller 3 including a magnet coil for IH (Induction Heating) (IH magnet coil) 20 to serve as a heating part; a cleaning unit 4 that cleans the surface of the peeling roller 2; and a separation member 5 for separating from the peeling roller 2 recording material P adhering to the surface of the peeling roller 2 because of heating and pressing in a nip N between the peeling roller 2 and the heat and pressure roller 3. The cleaning of the surface of the peeling roller 2 by the cleaning unit 4 is to remove an image forming substance thermally transferred onto the peeling roller 2 from the recording material P.

A pair of conveyance rollers 8, a pair of guide plates 9, a conveyance roller 10, and a guide plate 11 for conveying the recording material P having an image formed thereon, fed from a paper feed cassette 6 by a paper feed roller 7 on a sheet-by-sheet basis, to the nip N between the peeling roller 2 and the heat and pressure roller 3 are provided on the upstream side of the nip N in the rotational direction of the heat and pressure roller 3. Further, a pair of conveyance rollers 13, a guide plate 14, and a pair of paper discharge rollers 15 for conveying the recording material P from which the image has been peeled off and removed to a paper discharge tray 12 are provided on the downstream side of the separation member 5.

(Configuration of Peeling Roller 2)

Referring to FIG. 2, the peeling roller 2 includes a multilayer structure of a roller-shaped base body 16, a rubber elasticity layer 17 formed of a material having rubber elasticity and provided on the exterior surface of the base body 16, an organic polymer compound layer 18 formed of an organic polymer compound and provided on the rubber elasticity layer 17, and a thermoplastic composition layer 19 including a thermoplastic resin and provided on the organic polymer compound layer 18.

According to this embodiment, the base body 16 is formed of a roller-shaped metal material such as aluminum, stainless steel, steel, copper, or titanium in view of durability against applied pressure and heat resistance. It is preferable that the base body 16 be approximately 0.5 mm to 5 mm in thickness and approximately 10 mm to 60 mm in outside diameter. In the image remover of FIG. 1, a drive unit (not graphically illustrated) that rotates the peeling roller 2 is coupled to the shaft of the base body 16. In addition to the above-described metal materials, thermosetting organic polymer compounds having high heat resistance, thermoplastic organic polymer compounds, glass, and ceramics may also be employed as the material of the base body 16. Further, the base body 16 may be either hollow or cylindrical (solid).

It is preferable that the rubber elasticity layer 17 be formed of a rubber material having heat resistance because the surface of the peeling roller 2 is heated to approximately 70° C. to approximately 170° C. by the heat from the heat and pressure roller 3 described below. Further, it is preferable that the rubber elasticity layer 17 be formed of a rubber material having low thermal conductivity so as to be able to function as a heat insulating layer. Therefore, according to this embodiment, the rubber elasticity layer 17 is formed of silicone rubber 2 mm to 10 mm in thickness in order to satisfy these requirements. The silicone rubber preferably has a thermal conductivity of 0.70 W/m·K or less. It is particularly preferable to use foamed spongy silicone rubber.

Using a rubber material of low thermal conductivity for the rubber elasticity layer 17 makes it possible to increase temperature only at the surface and its vicinity of the peeling roller 2 inside the nip N formed by the peeling roller 2 and the heat and pressure roller 3. Therefore, even when image removal is performed at high speed, the image forming substance on the recording material P can easily reach a temperature at which the image forming substance becomes plastic. Further, the temperature increases only in the part of low heat capacity of the peeling roller 2 at and near its surface inside the nip N. Therefore, the temperature of the image forming substance on the recording material P and the thermoplastic composition layer 19 at the outermost surface of the peeling roller 2 lowers easily before reaching a position opposed to the separation member 5 with the rotation of the peeling roller 2 after passing through the nip N. Therefore, it is possible to prevent cohesion failure from occurring between the image forming substance on the recording material P and the thermoplastic composition layer 19 of the peeling roller 2 to cause the image forming substance to remain on the recording material P or to cause the thermoplastic composition layer 19 of the peeling roller 2 to be transferred in reverse to the recording material P at the time of separating the recording material P adhering to the surface of the peeling roller 2 with the separation member 5.

Further, by setting the thickness of the rubber elasticity layer 17 at 2 mm to 10 mm, it is possible to reserve (ensure) a nip width required to perform image removal at a practical image removal speed between the peeling roller 2 and the heat and pressure roller 3 even when the heat and pressure roller 3 is a rigid body like metal, and to form the heat and pressure roller 3 of a material having high thermal conductivity, such as metal. As a result, heat is supplied rapidly to the peeling roller 2 in the nip N, so that it is possible to perform image removal at high speed.

The rubber hardness of the rubber material forming the rubber elasticity layer 17 is preferably 10° to 90°, in particular, 20° to 60°, according to JIS S6050 in the case of using foamed spongy rubber. In the case of using non-foamed solid rubber, it is preferable to use rubber having a hardness of 10° to 80°, in particular, 25° to 50°, according to JIS K6301A. This is because if the rubber hardness is too low, an appropriate nip pressure for causing the image forming substance on the recording material P to adhere to the peeling roller 2 is less likely to be applied in the nip N where the peeling roller 2 and the heat and pressure roller 3 come into press contact.

On the other hand, if the rubber hardness is too high, a sufficient nip width is less likely to be obtained in the nip N where the peeling roller 2 and the heat and pressure roller 3 come into press contact. In this case, there is a problem in that the image forming substance on the recording material P and the thermoplastic composition layer 19 of the peeling roller 2 are prevented from being heated to a temperature necessary to cause the image forming substance to adhere to the peeling roller 2 or an excessively high pressure is applied to cause the thermoplastic composition layer 19 of the peeling roller 2 to be transferred in reverse to the recording material P.

According to the peeling roller 2 of this embodiment, the organic polymer compound layer 18, whose Young's modulus is 400 MPa to 6000 Mpa at normal temperature, is provided between the rubber elasticity layer 17 and the thermoplastic composition layer 19 provided at the outermost surface of the peeling roller 2. If the thermoplastic composition layer 19 is provided directly on the rubber elasticity layer 17 without this organic polymer compound layer 18, in particular, if the rubber elasticity layer 17 has a thickness of 2 mm or more in this case, the recording material P rises from the surface of a peeling roller 200 in a part thereof that has passed through the nip N formed by the peeling roller 200 and the heat and pressure roller 3 as shown in FIG. 3, so that stripes of residual images are formed on the recording material P in a direction perpendicular to the conveying direction of the recording material P.

Studies by the inventors of the present invention have found that it is possible to prevent the recording material P from rising from the surface of the peeling roller 2 in a part thereof that has passed through the nip N, that is, it is possible to prevent formation of a space between the surface of the peeling roller 2 and part of the recording material P that has passed through the nip N, by providing the organic polymer compound layer 18 having a Young's modulus substantially higher than that of the rubber elasticity layer 17 between the rubber elasticity layer 17 and the thermoplastic composition layer 19 as in the peeling roller 2 of this embodiment.

Figure 3:
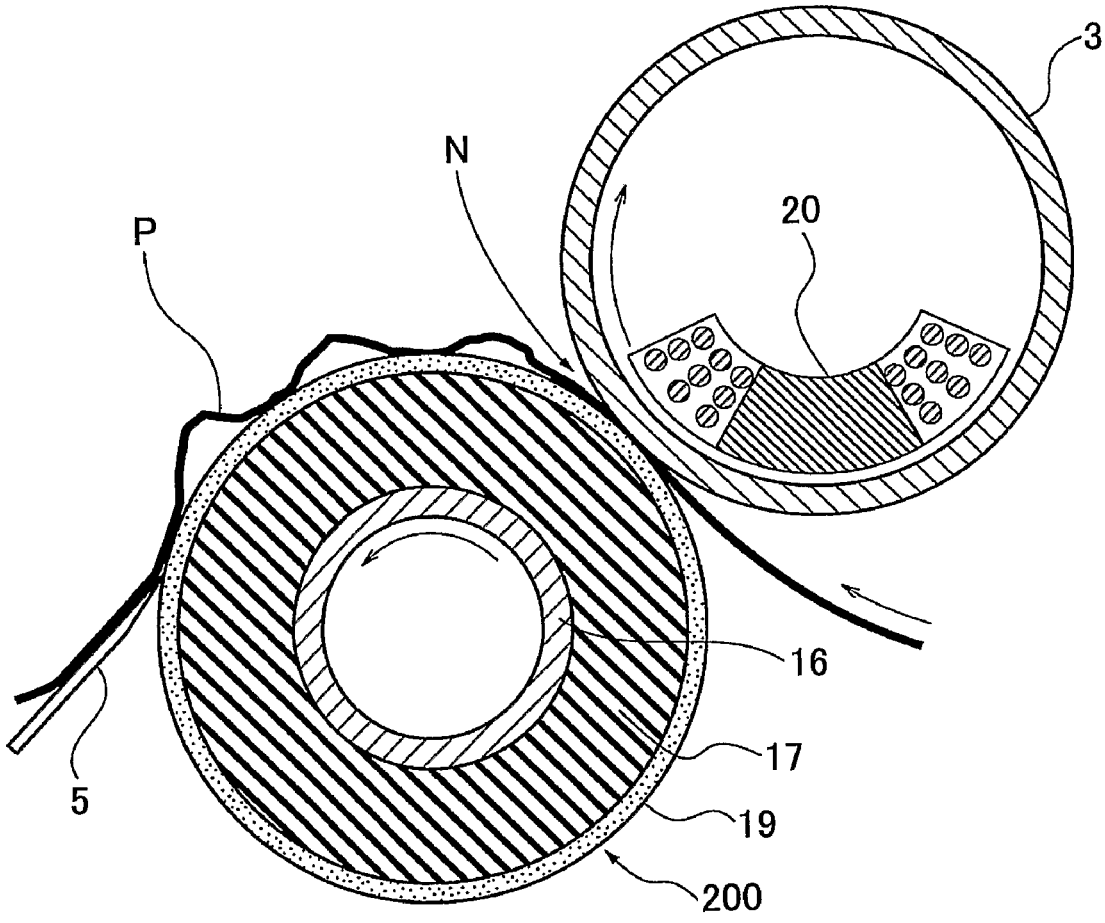
FIG. 3 is a diagram for illustrating the rising of recording material from the surface of a peeling roller after the recording material passes through a nip in the case of using the peeling roller without an organic polymer compound layer.

It is not known exactly why the recording material P rises from the peeling roller 200 without an organic polymer compound layer shown in FIG. 3 immediately after passing through the nip N. It is believed that in the case of providing the thermoplastic composition layer 19 directly on the rubber elasticity layer 17, a slip phenomenon periodically occurs in which the surface of the rubber elasticity layer 17 is restored to its original shape when a restoring force due to the deformation of the surface and its vicinity of the rubber elasticity layer 17 becomes more than or equal to a certain value after the deformation is accumulated because of no occurrence of a slip between the recording material P and the peeling roller 2 in the nip N due to an extremely low Young's modulus of the rubber elasticity layer 17.

That is, in the case of using a rigid body such as metal as the heat and pressure roller 3, the peeling roller 2 is deformed by an applied pressure in the nip N so that its effective diameter is reduced. Therefore, even in the case where the heat and pressure roller 3 (as a driven roller) and the peeling roller 2 are caused to rotate together by a frictional force due to the pressure, there is a difference in peripheral speed between the heat and pressure roller 3 and the peeling roller 2 in the nip N. In the case of providing the thermoplastic composition layer 19 directly on the rubber elasticity layer 17, the difference in peripheral speed causes the deformation of the surface of the rubber elasticity layer 17. On the other hand, in the case of providing the organic polymer compound layer 18 between the thermoplastic composition layer 19 and the rubber elasticity layer 17, no deformation is caused that substantially affects image removal because of a high Young's modulus of the organic polymer compound layer 18, so that the recording material P is conveyed in the nip N with a continuous slip being caused between the peeling roller 2 and the recording material P or between the peeling roller 2 and the heat and pressure roller 3. It is presumed that this makes it possible to prevent the recording material P from rising from the peeling roller 2 immediately after the recording material P passes through the nip N.

If the recording material P rises from the peeling roller 2 immediately after passing through the nip N so that a space is formed between the recording material P and the peeling roller 2, the image forming substance on the recording material P and the thermoplastic composition layer 19 of the peeling roller 2 are cooled in the space after their temperature has been increased inside the nip N, and the recording material P is separated from the peeling roller 2 before the cohesion of the image forming substance and the thermoplastic composition layer 19 becomes sufficiently high. Therefore, a cohesion failure is caused in the image forming substance on the recording material P, so that part of the image forming substance remains on the recording material P. Further, part of the thermoplastic composition layer 19 of the peeling roller 2 may be transferred in reverse to the recording material P.

Because of the occurrence of such a phenomenon, it is extremely difficult to completely remove an image if the peeling member 200 without an organic polymer compound layer is employed. It is possible to prevent the above-described rising by causing the nip pressure between the peeling roller 2 and the heat and pressure roller 3 to be extremely low or reducing the thickness of the rubber elasticity layer 17. In this case, however, there is not a sufficient nip width or nip pressure for sufficient adhesion of the image forming substance on the recording material P and the peeling roller 2. This results in problems such as incomplete image removal and a failure to obtain a practical processing speed. Therefore, it is preferable that the rubber elasticity layer 17 be 2 mm or more in thickness as described above in order to have sufficiently high adhesion between the image forming substance on the recording material P and the peeling roller 2. Such a thickness, however, causes the above-described rising so as to make it difficult to remove the image.

Preferably, the organic polymer compound layer 18 is prevented from impairing the elasticity of the rubber elasticity layer 17 on its lower side. Further, since the surface of the peeling roller 2 is heated to approximately 70° C. to approximately 170° C. by the heat from the heat and pressure roller 3, the organic polymer compound layer 18 preferably has heat resistance. It is preferable that the organic polymer compound layer 18 be smaller in thickness so as not to impair the elasticity of the rubber elasticity layer 17 on its lower side. Further, the studies by the inventors of the present invention have found that the smaller the thickness of the organic polymer compound layer 18 is, the better the recording material P is separated from the peeling roller 2 after passing through the nip N formed by the peeling roller 2 and the heat and pressure roller 3. However, too small a thickness of the organic polymer compound layer 18 causes problems such as manufacturing difficulty and generation of breakage by abrasion due to continuous use. Accordingly, it is preferable that the organic polymer compound layer 18 be 2 μm to 150 μm, in particular 2 μm to 90 μm, in thickness.

The organic polymer compound layer 18 also produces the effect of preventing components included in the thermoplastic composition layer 19, such as wax and a surfactant, from being transferred to the rubber elasticity layer 17 to swell and deform the rubber elasticity layer 17 or to change its physical property values such as modulus of elasticity. In order to obtain such a preventive effect also, it is preferable that the organic polymer compound layer 18 have a thickness more than or equal to a certain value.

Preferably, in addition to having the above-described characteristics, the organic polymer material forming the organic polymer compound layer 18 is highly adhesive to the thermoplastic composition layer 19 and/or the image forming substance, and is heat-resistant. According to the studies by the inventors of the present invention, polyether sulfones, polysulfones, polyetherimides, polyphenylene sulfides, polycarbonates, polyallylates, polyimides, and polyether ether ketones have (satisfy) each of the above-described physical properties and are preferable as the organic polymer material of the organic polymer compound layer 18.

The thermoplastic composition layer 19 employs a composition having a softening temperature of 150° C. or less, and is 5 μm to 100 μm in thickness. In image removal, the thermoplastic composition layer 19 flows and deforms in accordance with the unevenness of the image on the recording material P and the unevenness of the surface of the recording material P. Accordingly, there is good adhesion between the thermoplastic composition layer 19 and the image forming substance, so that the image removal characteristic is improved. Therefore, it is desirable that the thermoplastic composition layer 19 have the characteristic of being softened to flow at a temperature at which the recording material P is heated when passing through the nip N between the peeling roller 2 and the heat and pressure roller 3 at the time of image removal.

Figure 4:
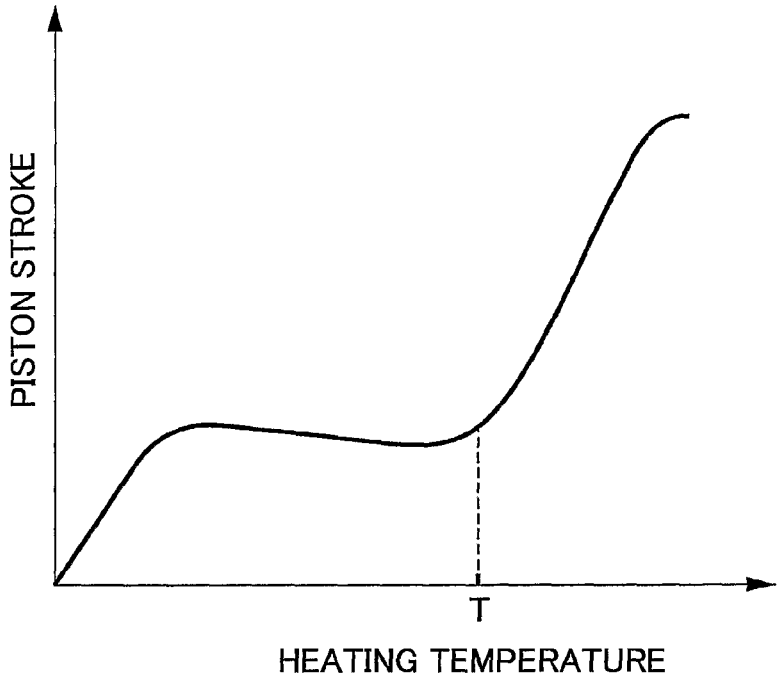
FIG. 4 is a graph showing a flow curve for determining the softening temperature of thermoplastic resin, measured with an elevated flow tester, according to the first embodiment of the present invention.

The softening temperature of the thermoplastic composition layer 19 may be determined from, for example, a flow curve measured using an elevated flow tester (Flow Tester CFT500 manufactured by Shimadzu Corporation). According to this embodiment, letting the load, rate of temperature increase, die diameter, and die length be 10 kg/cm$_2$, 3.0° C./min, 0.50 mm, and 1.0 mm, respectively, as measurement conditions, Temperature T is defined as the softening temperature (flow start temperature) of the thermoplastic composition layer 19 in the example flow curve shown in FIG. 4. In FIG. 4, the vertical axis represents the, piston stroke of the flow tester, and the horizontal axis represents the heating temperature.

If the thickness of the thermoplastic composition layer 19 is less than 5 μm, the image on the recording material P and the image forming substance adhering to the background cannot be completely removed. Usually, it is particularly difficult to remove an image forming substance from recording material on which an image with relatively large unevenness, such as a color electrophotographic image for normal commercial use, is formed. Further, if the thickness of the thermoplastic composition layer 19 is more than 100 μm, particularly, an end part of the recording material P in its conveyance direction is likely to be buried in the thermoplastic composition layer 19 of the peeling roller 19 in response to application of pressure to the conveyed recording material P in the nip N, so that it is likely to be difficult to separate the peeling roller 2 and the recording material P.

A composition for reducing adhesion to the image forming substance or adhesion to the thermoplastic composition layer 19 at the outermost surface of the peeling roller 2 is provided on the surface of the recording material P usually employed. However, the composition for reducing adhesion is not provided on an end face of the recording material P because the recording material P, which is shaped like a sheet, is cut off from a wide roll. Therefore, if the thickness of the thermoplastic composition layer 19 exceeds 100 μm, the recording material P has its end part in its conveyance direction buried in the thermoplastic composition layer 19 of the peeling roller 2 when the recording material P is conveyed into the nip N formed by the peeling roller 2 and the heat and pressure roller 3. This generates high adhesion between the end part of the recording material P in its conveyance direction and the thermoplastic composition layer 19, thus making it difficult to separate the recording material P from the peeling roller 2. Further, even if their separation is possible, there is a problem in that the end part of the recording material P in its conveyance direction after removal of the image forming substance is contaminated.

It is preferable that the thermoplastic composition layer 19 be formed of a composition substantially equal to the composition of the image forming substance forming the image on the recording material P or of a composition obtained by excluding components that do not cause a significant change in the thermophysical property, such as color material, an external additive, and a charge control agent, from the composition of the image forming substance. Further, it is preferable that the thermoplastic composition layer 19 include wax serving as a release agent. The wax is preferably 1 wt %, more preferably 1 wt % to 10 wt %, with respect to the entire thermoplastic composition layer 19. It is preferable to use a wax component included in the thermoplastic image forming substance forming the image on the recording material P as the wax added as a release agent.

Adding a release agent such as wax to the thermoplastic composition layer 19 improves a characteristic of separating the recording material P from the peeling roller 2, thus making it possible to prevent occurrence of trouble such as a paper jam due to poor separation.

Examples of the wax as a release agent include waxes having a melting point of 60° C. to 110° C., such as fluorine-containing polymer compounds, silicone-based polymer compounds, organic polymer compounds having a long chain alkyl group in a side chain thereof, carnauba wax, montan wax, beeswax, paraffin waxes, microcrystalline waxes, higher alkyl alcohols, higher fatty acids, higher fatty acid esters, and higher alkyl amides.

The material of the thermoplastic composition layer 19 includes thermoplastic resin as a principal component, and the thermoplastic resin included is more than or equal to 50 parts by weight relative the total weight of the thermoplastic composition layer 19. It is preferable to use resin employed as an image forming substance for common electrophotographic image forming apparatuses as the thermoplastic resin.

Examples of the thermoplastic resin include polyester resins provided by condensation polymerization using one or more kinds of carboxylic acids such as terephthalic acid, fumaric acid, maleic acid, succinic acid, glutaric acid, adipic acid, pimelic acid, suberic acid, azelaic acid, sebacic acid, brassylic acid, pyromellitic acid, citraconic acid, glutaconic acid, mesaconic acid, itaconic acid, teraconic acid, phthalic acid, isophthalic acid, hemimellitic acid, mellophanic acid, trimeric acid, prehnitic acid and mellitic acid and using one or more kinds of polyhydric alcohols such as bisphenol A, hydrogenated bisphenol A, ethylene glycol, propylene glycol, butanediol, neopentyldiol, hexamethylenediol, heptanediol, octanediol, pentaglycerol, pentaerythritol, cyclohexanediol, cyclopentanediol, pinacol, glycerine, etherified diphenols, catechol, resorcinol, pyrogallol, benzenetriol, fluoroglucitol and benzenetetraol; polymers of styrene or substituted styrene such as polystyrenes, poly(p-chlorostyrene)s and polyvinyl toluenes; styrenic copolymers such as styrene-p-chlorostyrene copolymers, styrene, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-glycidyl methacrylate copolymers, styrene-dimethyaminoethyl methacrylate copolymers, styrene-diethylaminoethyl methacrylate copolymers, styrene-diethylaminopropyl acrylate copolymers, styrene-ethylene glycol methacrylate copolymers, styrene-acrylonitrile copolymers, styrene-methyl vinyl ketone copolymers, styrene-methyl vinyl ketone copolymers, styrene-butadiene copolymers, styrene-isoprene copolymers, styrene-acrylonitrile-indene copolymers, styrene-maleic acid copolymers and styrene-maleate copolymers; polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, and the like.

Further, a color material may be added to the thermoplastic resin so as to make the physical properties more similar to those of the image forming substance to be removed. Examples of the color material to be added include known compounds such as black pigments such as carbon blacks and iron oxides, yellow pigments such as C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment Yellow 180 and C.I. Pigment Yellow 185, magenta color materials such as C.I. Pigment Red 2, C.I. Pigment Red 3, C.I. Pigment Red 5, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 166, C.I. Pigment Red 177, C.I. Pigment Red 178 and C.I. Pigment Red 222, and cyan color materials such as C.I. Pigment Blue 15, C.I. Pigment Blue 15:2, C.I. Pigment Blue 15:3, C.I. Pigment Blue 16 and C.I. Pigment Blue 60.

The thermoplastic composition layer 19 may employ a composition different from the image forming substance forming the image on the recording material at the beginning of use of the image remover 1. However, when image removal is repeatedly performed, the thermoplastic composition layer 19 is heated and softened, and in a fluid state, comes into press contact with the image forming substance on the recording material P at the time of image removal. Therefore, the thermoplastic composition layer 19 finally becomes a composition similar to the image forming substance on the recording material P as a result of long-term use or performing image removal processing on many recording material sheets. Therefore, in order to prevent a change in the image removal characteristic or the characteristic of separating the recording material P and the peeling roller 2 due to continuous or long-term use, it is preferable to use a composition similar or equal to the image forming substance on the recording material P or a composition having physical property values similar to those of the image forming substance as the thermoplastic composition layer 19 in the peeling roller 2 at its initial stage as well.

In terms of configuration, the peeling roller 2 basically includes the base body 16, the rubber elasticity layer 17, the organic polymer compound layer 18, and the thermoplastic composition layer 19 as described above. Instead of stacking these layers 17 through 19 on the base body 16, another (additional) layer may be provided in order to, for example, have better interlayer adhesion as long as it does not impair effects according to this embodiment of the present invention.

For example, primer treatment may be performed or an adhesive layer may be provided. In particular, since the adhesion between the base body 16 and the rubber elasticity layer 17 and the adhesion between the rubber elasticity layer 17 and the organic polymer compound layer 18 are not necessarily high, it is preferable to perform surface treatment with primer or to fix adjacent layers using an adhesive agent. However, it is preferable to prevent the function of the peeling roller 2 from being impaired by preventing the rubber elasticity of the peeling roller 2 from being impaired by causing the primer or adhesive agent between the rubber elasticity layer 17 and the organic polymer compound layer 18 to be less than or equal to 10 μm in thickness or using an adhesive agent having rubber elasticity.

(Configuration of Heat and Pressure Roller 3)

The heat and pressure roller 3 is formed of a roller-shaped metal member of aluminum or stainless steel with good thermal conductivity. The IH magnet coil 20 to serve as a heating part is provided inside the heat and pressure roller 3. The heat and pressure roller 3 is rotatably supported on a bearing part (not graphically illustrated). When the peeling roller 2 is driven by a drive unit (not graphically illustrated) to rotate in the direction of an arrow (counterclockwise in FIG. 1), the heat and pressure roller 3, which is in contact with the peeling roller 2 in the nip N, is driven to rotate in the direction of an arrow (clockwise in FIG. 1). In place of the IH magnet coil 20, a halogen lamp for heating may also be used as a heating part.

As the heat and pressure roller 3 becomes thinner, its heat capacity becomes lower, thus resulting in good temperature rising and high thermal conductivity, so that it is possible to perform image removal at higher speed. Accordingly, it is preferable to reduce the thickness of the heat and pressure roller 3 as long as it is not deformed by press contact with the peeling roller 2. Specifically, it is preferable that the heat and pressure roller 3 be approximately 0.3 mm to approximately 1 mm in thickness.

The surface of the heat and pressure roller 3 is coated with, for example, an organic polymer compound of low surface energy, such as polytetrafluoroethylene or perfluoroalkyl vinyl ether resin, so as to prevent the thermoplastic composition of the thermoplastic composition layer 19 of the peeling layer 2 from being transferred and adhering to the heat and pressure roller 3 in the nip N.

The heat and pressure roller 3 is heated to a predetermined temperature by the eddy current caused by applying a high-frequency current to the IH magnet coil 20. A temperature sensor (not graphically illustrated) is provided at or near the surface of the heat and pressure roller 3. A temperature control part (not graphically illustrated) performs control based on temperature detection information from this temperature sensor so that the surface temperature of the heat and pressure roller 3 is constant within 80° to 180° C., preferably within 90° to 150° C. Further, a pressure applicator (not graphically illustrated) that applies a predetermined pressure to the peeling roller 2 through a spring force is connected to the heat and pressure roller 3 so as to apply pressure so that the nip N between the peeling roller 2 and the heat and pressure roller 3 has a predetermined nip width.

With respect to the magnitude of the applied pressure, for example, letting the axial length (width) of the peeling roller 2 be approximately 300 mm, it is appropriate to apply a force of approximately 50 N to approximately 200 N to each end of the shaft of each of the heat and pressure roller 3 and the peeling roller 2 in order to make it possible to perform image removal while cross-feeding A4 recording material. By setting the applied pressure so that the surface pressure of the nip N is $1\times10^5$ Pa to $6\times10^5$ Pa and the nip width is 3 mm to 13 mm, it is possible to cause the image forming substance on the recording material P to suitably adhere to the peeling roller 2.

(Configuration of Cleaning Unit 4)

The cleaning unit 4 includes a cleaning roller 21 rotatably supported in contact with the surface of the peeling roller 2, a halogen lamp for heating (heating halogen lamp) 22 provided inside the cleaning roller 21, a cleaning blade 23 provided so as to have its end in contact with the surface of the cleaning roller 21, and a collection container 24.

A drive unit (not graphically illustrated) is connected to the cleaning roller 21. The cleaning roller 21 is configured to be driven by the drive unit to rotate at a peripheral speed 1.2 to 10 times the peripheral speed of the peeling roller 2 in the direction of an arrow (counterclockwise in FIG. 1). Further, an appropriate gap maintaining mechanism (not graphically illustrated) is provided between the cleaning roller 21 and the peeling roller 2 in order to keep constant the thickness of the thermoplastic composition layer 19 of the peeling roller 2. For example, the gap between the peeling roller 2 and the cleaning roller 21 is maintained so as to be able to keep constant the thickness of the thermoplastic composition layer 19 of the peeling roller 2 by providing a ring on the shaft part of the cleaning roller 21 so that the ring is in contact with the shaft part of the peeling roller 2.

Further, the cleaning roller 21 includes a pressure applicator (not graphically illustrated) that applies a predetermined pressure to the surface of the peeling roller 2 through a spring force when the thickness of the thermoplastic composition layer 19 of the peeling roller 2 becomes more than or equal to a predetermined value because of accumulation of the image forming substance transferred thereto from the recording material P. The cleaning roller 21 is configured to come into contact with part of the peeling roller 2 where its thickness exceeds the predetermined value with the predetermined pressure. The surface of the cleaning roller 21 is formed of a heat-resistant polymer compound such as polyether ether ketone or polyimide, or metal material such as stainless steel or aluminum.

(Configuration of Separation Member 5)

Figure 5:
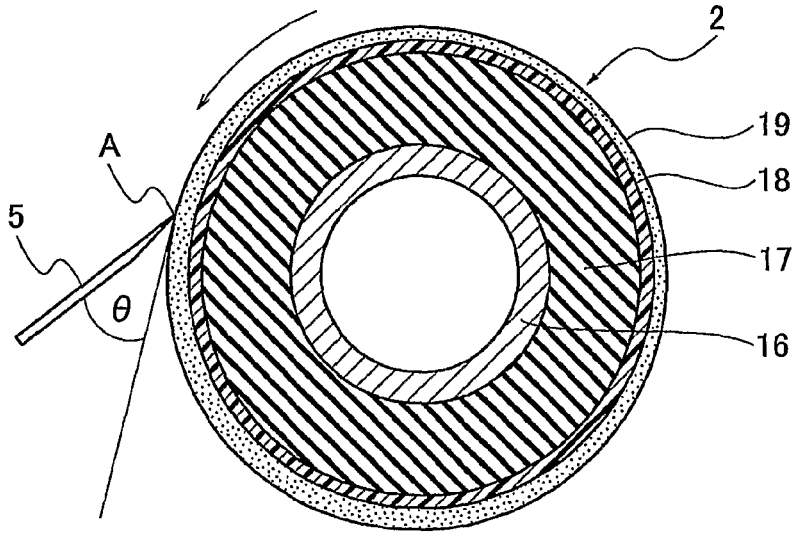
FIG. 5 is a diagram showing the positional relationship between the peeling roller and a separation member according to the first embodiment of the present invention.

The separation member 5 separates the recording material P, heated and pressed to adhere to the surface of the peeling roller 2 when passing through the nip N, from the surface of the peeling roller 2. Referring to FIG. 5, letting the angle formed by the tangential direction of the peeling roller 2 and the separation member 5 at a separation position A where the recording material P is separated (a position where the tip [end part] of the separation member 5 is in substantial contact with the surface of the peeling roller 2) be θ, the angle θ is 5 to 35 degrees.

If the angle θ of the separation member 5 is more than or equal to 5 degrees, the characteristic of separation of the recording material P from the peeling roller 2 and the characteristic of image removal are remarkably improved. It is presumed that this is because the curvature of the recording material P to be separated changes greatly at the separation position A so that a shearing force due to expansion and contraction acts between the recording material P and the image forming substance to reduce the adhesion between the recording material P and the image forming substance. If the angle θ of the separation member 5 exceeds 35 degrees, the curvature of the recording material P to be separated changes excessively, so that a jam is caused by poor separation to make it difficult to convey the separated recording material P to the conveyance rollers 13 on the downstream side along the separation member 5. In particular, the rate of jam occurrence is extremely high if the recording material P employs paper of a common basic weight of 60 g/m$^2$ to 110 g/m$^2$ as a base body.

In this embodiment, the tip of the separation member 5 is in contact with the surface of the peeling roller 2. Alternatively, a minute gap of approximately 0.05 mm to approximately 2 mm may be provided between the tip of the separation member 5 and the surface of the peeling roller 2.

Figure 6:
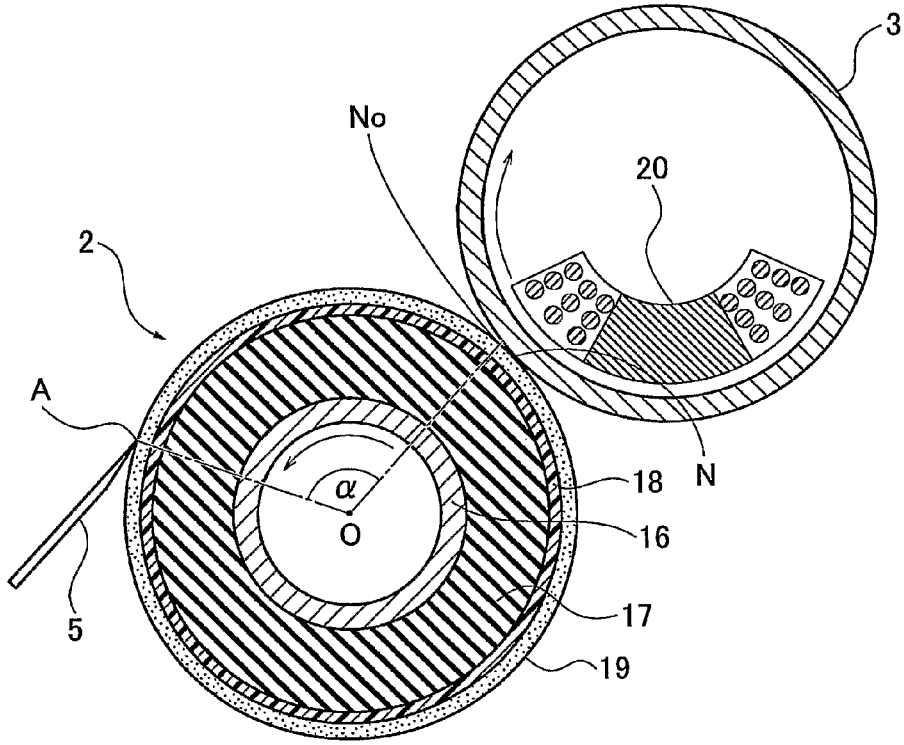
FIG. 6 is a diagram illustrating the angle between the exit of a nip and a separation position where the recording material is separated along the rotational direction of the peeling roller according to the first embodiment of the present invention.

Further, letting the rotation center of the peeling roller 2 be O and letting the angle between the exit No of the nip N and the separation position A where the recording material P is separated along the rotational direction of the peeling roller 2 be α as illustrated in FIG. 6, it is preferable that the angle α be 40 degrees to 270 degrees, in particular 60 degrees to 200 degrees, if the peeling roller 2 has a peripheral speed of 20 mm/s to 100 mm/s and a diameter of 20 mm to 80 mm.

Thus, by causing the angle α to be 40 degrees to 270 degrees (preferably 60 degrees to 200 degrees), the image forming substance on the recording material P and the thermoplastic composition layer 19 at the outermost surface of the peeling roller 2, heated and softened at the time of passing through the nip N, are sufficiently cooled naturally after passing through the nip N. This, in combination with the thermal insulation property of the rubber elasticity layer 17 of the peeling roller 2, increases the cohesion of the image forming substance and the thermoplastic composition layer 19. As a result, it is possible to suitably separate the recording material P from the surface of the peeling roller 2 at the separation position A by the separation member 5. Further, since no cohesion failure is caused, it is possible to satisfactorily remove the image forming substance from the recording material P and to prevent the thermoplastic composition layer 19 of the peeling roller 2 from being transferred in reverse to the recording material P. In order to produce these effects, it is desired that no heating source be provided inside the peeling roller 2 as in the image remover 1.

If the angle α is less than 40 degrees, the image forming substance on the recording material P and the thermoplastic composition layer 19 at the outermost surface of the peeling roller 2, heated and softened at the time of passing through the nip N, are insufficiently cooled after passing through the nip N, thus resulting in a low cohesion of the image forming substance and the thermoplastic composition layer 19. Thus, it is likely to be difficult to suitably separate the recording material P from the surface of the peeling roller 2 at the separation position A by the separation member 5, and an image is likely to remain on the recording material P after image removal processing or the thermoplastic composition layer 19 of the peeling roller 2 is likely to be transferred in reverse to the recording material P. Further, if the angle α exceeds 270 degrees, it is difficult to provide the separation member 5 and the cleaning unit 4 without mutual interference.

In the image removers (described above in the first embodiment and below in second and third embodiments) and the image forming and removing system (described below in a fourth embodiment) including the peeling member according to the present invention, it is preferable that so-called reusable recording material, in which paper or a film to serve as a base body is provided in advance with a composition that reduces fixation (adhesion) to the image forming substance, be used as the recording material P.

Further, the image removers (described above in the first embodiment and below in the second and third embodiments) and the image forming and removing system (described below in the fourth embodiment) including the peeling member according to the present invention may also be used in an image forming method that uses recording material commonly used for image recording, or plain paper, and forms an image with an image forming substance having a low fixation characteristic and in a method that applies an image removal accelerating liquid such as an aqueous solution including a surfactant to recording material in image removal.

However, if an image forming substance having a low fixation characteristic is used, it is necessary to use a different image forming substance than the case where a high fixation characteristic is required in an image forming apparatus. This causes a problem in that different image forming apparatuses should be used or many different development units should be provided and used in the image forming apparatus, thus lacking in practicality. Further, according to the method of removing an image by applying an image removal accelerating liquid, it is necessary to provide a liquid supply part in the image remover or it is necessary to dry the image removal accelerating liquid applied to recording material, so that there is a problem in that the image remover becomes complicated and expensive.

On the other hand, the image removers (described above in the first embodiment and below in the second and third embodiments) and the image forming and removing system (described below in the fourth embodiment) including the peeling member according to the present invention have a high image removal characteristic. Therefore, by using reusable recording material in which paper or a film to serve as a base body is provided in advance with a composition that reduces fixation (adhesion) to the image forming substance, it is possible to satisfactorily remove an image formed thereon even if the reusable recording material has a relatively high fixation characteristic.

Examples of the compound that is included in the recording material P to reduce the adhesion (adhesive force) of the image forming substance include a surfactant. For example, Japanese Laid-Open Patent Application No. 10-74025 discloses suitable usability of paper on which is applied a fluorine-containing surfactant, a silicone-based surfactant or a surfactant containing a linear or branched alkyl group in which the number of carbons in the molecule thereof is at least 8.

Specific examples of the fluorine-containing surfactant include anionics such as fluoroalkylcarboxylates and fluoroalkylsulfonates, amphoterics such as fluoroalkyl-substututed betaines, nonionics, and cationics. Further, specific examples of the silicone-based surfactant include epoxy-modified, alkyl-modified, aralkyl-modified, amino-modified, carboxyl-modified, alcohol-modified, fluorine-modified and polyether-modified silicone oils and the like.

Moreover, specific examples of the surfactant containing a linear or branched alkyl group in which the number of carbons in the molecule thereof is at least 8 include anionics such as alkylcarboxylates, alkylsulfuric acid ester salts, alkylsulfonates and alkylphosphoric acid ester salts, cationics such as alkylamine salts, alkylamine derivatives, quaternary ammonium salts, imidazoline and imidazolium salts, and amphoterics such as betaine.

Examples of recording material having a silicone compound applied to its surface are shown in, for example, Japanese Laid-Open Patent Application No. 9-204060 and Japanese Laid-Open Patent Application No. 9-204061 and specific examples of the silicone-based compound include silicone resins and silane coupling agents. Further, in the case of applying a fluorine-containing resin, an olefin resin, a wax, or the like to the recording material also, it is possible to reduce the adhesion (adhesive force) of the image forming substance.

Among these compounds, it is preferable to use an olefin-maleic anhydride polymer for a compound for reducing fixation to the image forming material, in particular. When a polymer compound provided by polymerization using an olefin monomer having a double bond at α-position thereof and a carbon number of 10-20 is particularly used for an olefin component of the olefin-maleic anhydride polymer, a good fixation property and an image removing property may be obtained in the case where an image is formed by a commonly used electrophotographic image forming apparatus. Further, a stable image fixation property and image removing property may be obtained even if a cycle of image removal and image formation is repeated for the same recording material.

It is preferable to use paper formed mainly of cellulose fibers for the base body of the reusable recording material in terms of having heat resistance, reducing the environmental impact, and availability at low cost. However, the base body does not always have to be paper, and may be a sheet of synthetic resin having at least a surface treated to provide diffuse reflection, such as synthetic paper, or a film of polyethylene terephthalate or the like.

(Image Removing Method)

Next, a description is given of a method of removing an image (image forming substance) from the recording material P, on which the image is formed with the image forming substance, using the image remover 1 having the peeling roller 2.

As illustrated in FIG. 1, multiple sheets of the recording material P are loaded in the paper feed cassette 6 with their surfaces having images formed thereon facing downward. The image on the recording material P formed of an image forming substance is, for example, formed by an image forming operation by an image forming apparatus such as a known electrophotographic copier. In this embodiment, the above-described reusable recording material is used as the recording material P.

The recording material P is fed sheet by sheet by the rotation of the paper feed roller 7, and the fed recording material P is conveyed to the nip N between the peeling roller 2 and the heat and pressure roller 3 through the conveyance rollers 8, the guide plates 9, the conveyance roller 10, and the guide plate 11. When the recording material P heated by the energized IH magnet coil 20 is held and conveyed in the nip N having a predetermined width, the thermoplastic composition layer 19 softened into a plastic state at the outermost surface of the peeling roller 2 is pressed against the image forming substance forming the image on the recording material P. As a result, the image forming substance on the recording material P adheres to the thermoplastic composition layer 19 of the peeling roller 2.

At this point, the thermoplastic composition layer 19 of the peeling roller 2 is softened into a plastically-deformable fluid state as described above. Therefore, even if a color image is formed on the recording material P by superposing image forming substances of multiple colors so that the image is "high" to include unevenness with large steps, the thermoplastic composition layer 19 satisfactorily comes into contact with the entire uneven image surface so as to ensure removal or reception of the image forming substance from the recording material P by the peeling roller 2. Further, even if a little amount of the image forming substance has scattered and adhered around the image on the recording material P, the thermoplastic composition layer 19 softened into the plastically-deformable fluid state as described above satisfactorily comes into contact to ensure removal of the image forming substance that has scattered and adhered around the image. Further, in the case of using reusable recording material relatively low in flatness in order to improve fixation or writability with writing instruments also, the thermoplastic composition layer 19 of the peeling roller 2 deforms in accordance with the unevenness of the surface of the recording material to be able to satisfactorily come into contact with the image forming substance. Accordingly, it is possible to ensure removal of the image forming substance.

Then, the recording material P moves toward the separation member 5 with the rotation of the peeling roller 2 while adhering to the thermoplastic composition layer 19 of the peeling roller 2. At this point, since the rubber elasticity layer 17 is formed of rubber material having low thermal conductivity so as to be able to function as a heat insulating layer, the thermoplastic composition layer 19 and the organic polymer compound layer 18 are rapidly cooled after the recording material P passes through the nip N, so that the cohesion of the thermoplastic composition layer 19 of the peeling roller 2 and the image forming substance on the recording material P increases.

As a result, it is possible to prevent the thermoplastic composition layer 19 of the peeling roller 2 from adhering to the separation member 5 even when the separation member 5 comes into contact with the peeling roller 2, and the recording material P is satisfactorily separated from the thermoplastic composition layer 19 of the peeling roller 2 by the tip of the separation member 5. Further, it is also possible to prevent the image forming substance on the recording material P from adhering to the separation member 5. When the recording material P is separated from the peeling roller 2, the image forming substance on the recording material P remains only on the peeling roller 2, and the image forming substance on the recording material P is removed. The separated recording material P is discharged onto the paper discharge tray 12 through the conveyance rollers 13, the guide plate 14, and the paper discharge rollers 15.

Further, the image forming substance thermally transferred onto the thermoplastic composition layer 19 of the peeling roller 2 is transferred onto the surface of the cleaning roller 21 of the cleaning unit 4, which cleaning roller 21 is rotated at a peripheral speed 1.2 to 10 times the peripheral speed of the peeling roller 2, so that the thermoplastic composition layer 19 of the peeling roller 2 is cleaned, having the image forming substance removed therefrom. At this point, the cleaning roller 21 can satisfactorily transfer the heated image forming substance from the thermoplastic composition layer 19 onto the surface of the cleaning roller 21 by being heated to a predetermined temperature by controlling energization of the heating halogen lamp 22. The image forming substance transferred onto the surface of the cleaning roller 21 is taken off by the cleaning blade 23, and taken-off image forming substance T is collected into the collection container 24.

According to the image remover 1 of this embodiment, it is possible to prevent a component of the thermoplastic composition layer 19 formed at the outermost surface from penetrating through to the rubber elasticity layer 17 by providing the organic polymer compound layer 18 between the thermoplastic composition layer 19 and the rubber elasticity layer 17 in the peeling roller 2. Accordingly, even if the same peeling roller 2 is used for a long period of time, there is little change in physical properties such as the modulus of elasticity of the rubber elasticity layer 17, so that it is possible to repeatedly remove an image formed on the recording material P stably and completely.

Further, the organic polymer compound layer 18 provided between the thermoplastic layer 19 of the peeling roller 2 and the elasticity layer 17 has a high Young's modulus of 400 MPa to 6000 Mpa at normal temperature. Accordingly, as described above, the recording material P is conveyed into the nip N while a continuous slip is caused between the peeling roller 2 and the recording material P or between the peeling roller 2 and the heat and pressure roller 3 without causing any deformation substantially affecting image removal.

As a result, the recording material P is prevented from rising from the surface of the peeling roller 2 after passing through the nip N, and is conveyed to the separation position A (FIG. 5) with the image forming substance on the recording material P adhering to the thermoplastic composition layer 19 of the peeling roller 2. As a result, it is possible to prevent cohesion failure of the image forming substance on the recording material P and the thermoplastic composition layer 19 of the peeling roller 2, which is caused when the conveyed recording material P rises from the surface of the peeling roller 2. Therefore, as described above, it is possible to completely remove the image forming substance on the recording material P, and it is possible to prevent the thermoplastic composition layer 19 of the peeling roller 2 from being transferred in reverse to the recording material P.

(Method of Manufacturing Peeling Roller 2)

Next, a description is given of a method of manufacturing the peeling roller 2.

First, a tube 2 μm to 150 μm thick of organic polymer material such as polyimide is manufactured. A rubber elasticity layer 2 mm to 10 mm thick of silicone rubber is provided on a base body formed of roller-shaped metal material (for example, aluminum, stainless steel, steel, copper, or titanium). Thereafter, this rubber elasticity layer is covered with the tube formed of the above-described organic polymer material (organic polymer compound layer).

More specifically, a seamless tube is formed by forming a film of the organic polymer compound layer on a mold for forming the tube by dipping and pulling out the film from the mold, or the material of the organic polymer compound layer is formed into a tube shape by extrusion molding or centrifugal application and hardening. Alternatively, a tube-shaped film formed by bonding and joining film pieces is prepared. Then, an adhesive agent is applied on the exterior surface of the rubber elasticity layer provided on the roller-shaped base body or on the interior surface of the tube, and the roller-shaped base body provided with the rubber elasticity layer is covered with the tube to serve as the organic polymer compound layer.

Normally, the coefficient of thermal expansion of a rubber member is higher than that of polyimide to serve as the organic polymer compound layer. Therefore, it is possible to provide good adhesion between the rubber elasticity layer and the organic polymer compound layer by covering the roller-shaped base body provided with the rubber elasticity layer with the tube to serve as the organic polymer compound layer at or below room temperature and thereafter bonding the rubber elasticity layer and the organic polymer compound layer by thermally hardening the adhesive agent by increasing temperature.

According to another manufacturing method, the tube to serve as the organic polymer compound layer and a core bar to serve as the roller-shaped base body are fixed in a mold. Rubber material before hardening is poured into the space between the core bar and the tube, and is heated while being kept in the mold, thereby hardening or foaming the rubber. Thereby, the rubber elasticity layer and the organic polymer compound layer can be provided on the core bar (base body).

Further, if the peeling roller 2 is large in diameter so that a seam does not become an issue, the organic polymer compound layer may be provided by cutting a sheet-shaped material of the organic polymer compound layer to a length substantially equal to the perimeter of the roller-shaped base body provided with the rubber elasticity layer and bonding the sheet-shaped material directly to the base body provided with the rubber elasticity layer. Further, in the case of providing a resin soluble in a solvent, such as polycarbonate, as the organic polymer compound layer, the organic polymer compound layer may be provided by dissolving the material of the organic polymer compound layer in a solvent and applying the solution on the roller-shaped base body by an application method such as dipping or spray coating.

Then, a thermoplastic composition layer including the above-described thermoplastic resin and the above-described wax as a release agent is formed to be approximately 5 μm to approximately 100 μm in thickness on this organic polymer compound layer. As a result, the peeling roller 2 shown in FIG. 2, having the rubber elasticity layer 17, the organic polymer compound layer 18, and the thermoplastic composition layer 19 stacked on the base body 16, can be obtained.

Figure 7:
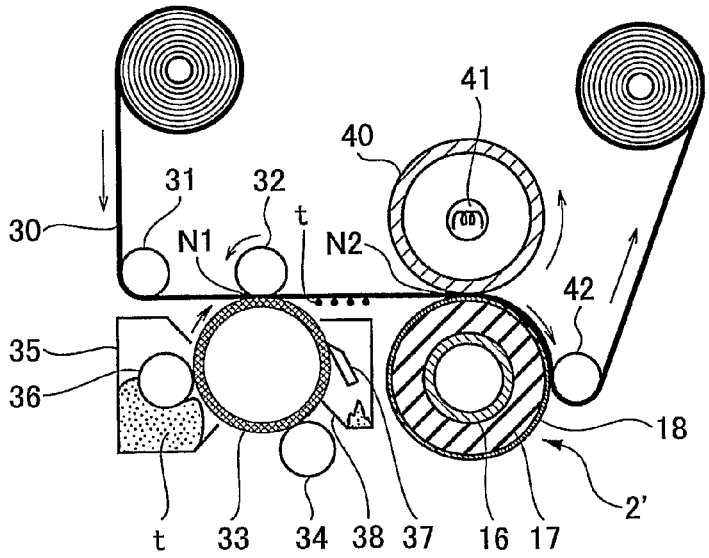
FIG. 7 is a diagram illustrating a method of manufacturing the peeling roller using a web-shaped member according to the first embodiment of the present invention.
Figure 8:
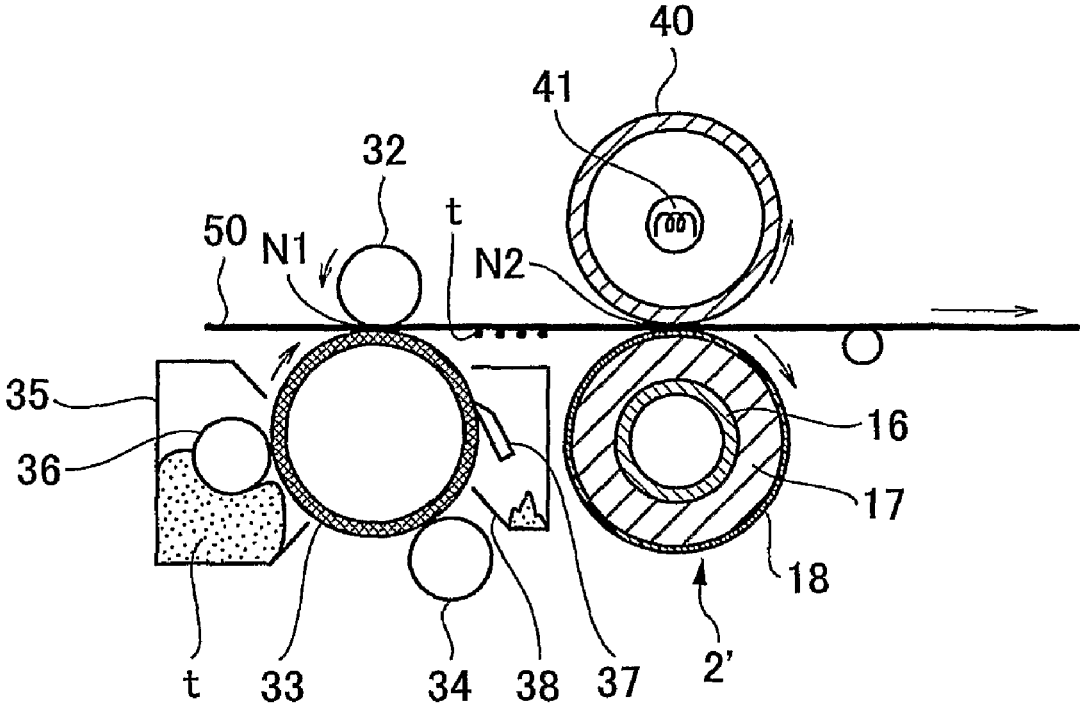
FIG. 8 is a diagram illustrating a method of manufacturing the peeling roller using a sheet-shaped member according to the first embodiment of the present invention.
Figure 9A:
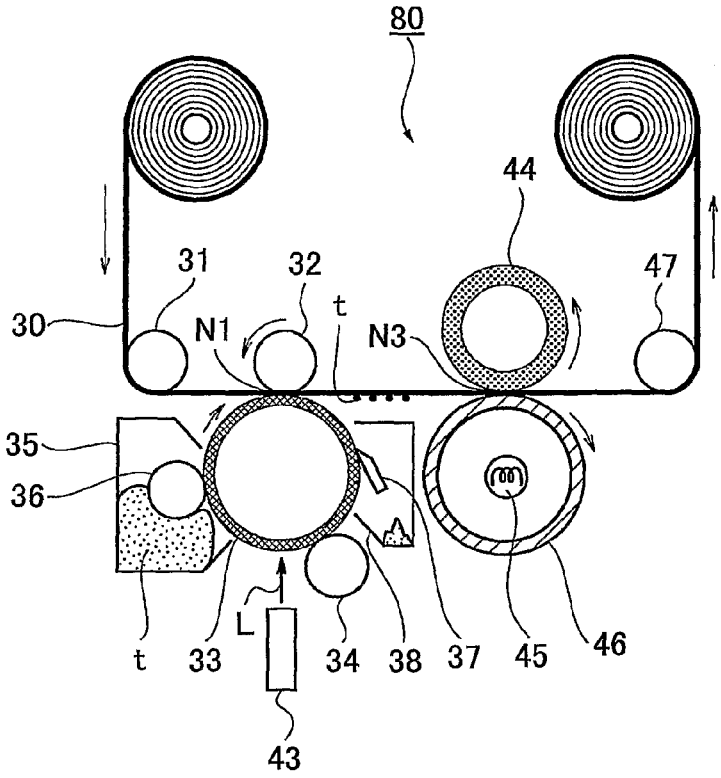
FIGS. 9A and 9B are diagrams illustrating another method of manufacturing the peeling roller using the web-shaped member according to the first embodiment of the present invention.
Figure 9B:
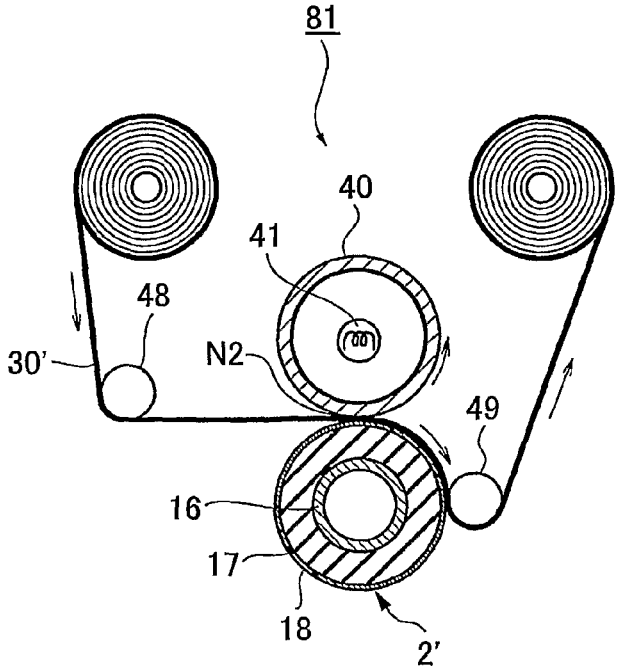

The thermoplastic composition layer 19 may be formed on the organic polymer compound layer 18 by, for example, a method using a web-shaped member as shown in FIG. 7, a method using a sheet-shaped member as shown in FIG. 8, or a method using a first unit and a second unit as shown in FIG. 9A and FIG. 9B, respectively.

In the method shown in FIG. 7, first, a web-shaped member 30 is sent out at a predetermined conveyance speed to be conveyed through a roller 31 to a nip N1 between a transfer roller 32 and a photosensitive body roller 33 having a photoconductor layer (or a dielectric layer) of approximately 5 μm to approximately 100 μm in thickness at its surface. The photosensitive body roller 33 is rotated in the direction of an arrow (clockwise in FIG. 7) by a drive unit (not graphically illustrated), and the transfer roller 32, which is in contact with the photosensitive body roller 33 at the nip N1, is driven to rotate in the direction of an arrow (counterclockwise in FIG. 7). At this point, the surface of the photosensitive body roller 33 is evenly charged by a charging roller 34 in contact therewith, so that thermoplastic composition powder t contained in a container 35 is caused by a development roller 36 to electrostatically adhere to the surface of the charged photosensitive body roller 33 so as to have a predetermined thickness. This thermoplastic composition powder t includes at least the above-described thermoplastic resin and the above-described wax as a release agent.

When the web-shaped member 30 is held and conveyed in the nip N1, the thermoplastic composition powder t adhering to the surface of the photosensitive body roller 33 is transferred to the surface of the web-shaped member 30 through an electric field generated from the transfer roller 32 to which a transfer bias is applied. Part of the thermoplastic composition powder t remaining on the surface of the photosensitive body roller 33 without being transferred is removed by a cleaning blade 37 to be collected into a collection container 38.

Then, this web-shaped member 30 is conveyed to a nip N2 between a heat and pressure roller 40 and a roller-shaped member for forming a peeling member (a peeling member forming member) 2'. This roller-shaped peeling member forming member 2' is formed by forming the organic polymer compound layer 18 on the rubber elasticity layer 17 provided on the base body 16 as described above. Thus, the peeling member forming member 2' may be a semi-finished product of the peeling member 2. The peeling member forming member 2' is rotated in the direction of an arrow (clockwise in FIG. 7) by a drive unit (not graphically illustrated), and the heat and pressure roller 40, which is in contact with the peeling member forming member 2' at the nip N2, is driven to rotate in the direction of an arrow (counterclockwise in FIG. 7). The surface of the heat and pressure roller 40 is heated to a predetermined temperature by a halogen lamp for heating (a heating halogen lamp) 41 provided inside the heat and pressure roller 40, and applies heat to the peeling member forming member 2' and the thermoplastic composition powder t adhering to the surface of the held and conveyed web-shaped member 30 in the nip N2.

When the web-shaped member 30 is held and conveyed in the nip N2, the thermoplastic composition powder t on the surface of the web-shaped member 30 is softened by the heat and pressure applied by the heat and pressure roller 40 so as to adhere onto the organic polymer compound layer 18 of the rotating peeling member forming member 2'. The web-shaped member 30, having the thermoplastic composition powder t on its surface adhering to the organic polymer compound layer 18 of the rotating peeling member forming member 2', is separated from the peeling member forming member 2' by a roller 42 while being naturally cooled after passing through the nip N2. At this point, the thermoplastic composition formed on the web-shaped member 30 is transferred onto the organic polymer compound layer 18 of the peeling member forming member 2', and the separated web-shaped member 30 is wound up.

The thermoplastic composition on the surface of the web-shaped member 30 is transferred by the applied heat and pressure onto the organic polymer compound layer 18 of the peeling member forming member 2' to be 5 μm to 100 μm in thickness, so that a thermoplastic composition layer is formed. As a result, the peeling roller 2 having the thermoplastic composition layer 19 at its outermost surface as shown in FIG. 2 is obtained. Then, the peeling roller 2 obtained by forming the thermoplastic composition layer 19 on the organic polymer compound layer 18 of the peeling member forming member 2' is detached, and another peeling member forming member 2' having the organic polymer compound layer formed at its surface is set (attached). Thereby, another peeling roller 2 having the thermoplastic composition layer 19 at its outermost surface can be manufactured in the same manner.

FIG. 8 is a schematic diagram illustrating a method using a sheet-shaped member. In FIG. 8, the members having the same function as those used in the method illustrated in FIG. 7 are referred to by the same reference numerals, and redundant descriptions thereof are omitted.

In the method illustrated in FIG. 8, a sheet-shaped member 50 is conveyed to the nip N1 between the transfer roller 32 and the photosensitive body roller 33, so that the sheet-shaped member 50 is held and conveyed in the nip N1. At this point, the thermoplastic composition powder t adhering to the surface of the photosensitive body roller 33 from the development roller 36 is transferred to the surface of the sheet-shaped member 50 through an electric field generated from the transfer roller 32 to which a transfer bias is applied.

The sheet-shaped member 50 is conveyed to the nip N2 between the heat and pressure roller 40 and the roller-shaped peeling member forming member 2', so that the sheet-shaped member 50 is held and conveyed in the nip N2. At this point, the thermoplastic composition powder t transferred to the surface of the sheet-shaped member 50 is softened by the heat and pressure applied by the heat and pressure roller 40 having the built-in heating halogen lamp 41 so as to adhere to the organic polymer compound layer 18 of the rotating roller-shaped peeling member forming member 2'. Then, the thermoplastic composition powder t on the surface of the sheet-shaped member 50 is transferred by the applied heat and pressure onto the organic polymer compound layer 18 of the peeling member forming member 2' to be 5 μm to 100 μm in thickness, so that a thermoplastic composition layer is formed. As a result, the peeling roller 2 having the thermoplastic composition layer 19 at its outermost surface as shown in FIG. 2 is obtained.

FIGS. 9A and 9B are schematic diagrams illustrating another method, which uses a first unit and a second unit. In FIGS. 9A and 9B, the members having the same function as those used in the method illustrated in FIG. 7 are referred to by the same reference numerals, and a redundant description thereof is omitted. Referring to FIGS. 9A and 9B, the web-shaped member 30 is used, but it is also possible to use the sheet-shaped member 50 in the same manner.

First, in a first unit 80 illustrated in FIG. 9A, a predetermined position on the surface of the charged rotating photosensitive body roller 33 is exposed to laser light L emitted from an exposure unit 43 so that the thermoplastic composition powder t, which is caused to adhere by the development roller 36, is prevented from electrostatically adhering to the exposed position. That is, exposure is performed with the exposure unit 43 so that the thermoplastic composition powder t continuously adheres to the web-shaped member 30 so as to correspond to the perimeter or the integral multiple of the perimeter of the peeling member forming member 2' (FIG. 9B) and a blank part to which the thermoplastic composition powder t does not adhere is provided between each adjacent two of sections of the web-shaped member 30 where the thermoplastic composition powder t continuously adheres in each section.

Then, when the web-shaped member 30 is held and conveyed in the nip N1, the thermoplastic composition powder t adhering to the surface of the photosensitive body roller 33 is transferred to the surface of the web-shaped member 30 through an electric field generated from the transfer roller 32 to which a transfer bias is applied. This web-shaped member 30 is conveyed to a nip N3 between a pressure roller 44 and a fixation roller 46 having a built-in heating halogen lamp 45. The fixation roller 46 is rotated in the direction of an arrow (clockwise in FIG. 9A) by a drive unit (not graphically illustrated), and the pressure roller 44, which is in contact with the fixation roller 46 at the nip N3, is driven to rotate in the direction of an arrow (counterclockwise in FIG. 9A).

When the web-shaped member 30 is conveyed in the nip N3, the thermoplastic composition powder t on the surface of the web-shaped member 30 is thermally fixed onto the surface of the web-shaped member 30 with the fixation roller 46 heated by the heating halogen lamp 45, and the web-shaped member 30 is wound up through a roller 47.

Then, in a second unit 81 illustrated in FIG. 9B, a web-shaped member 30' having the thermoplastic composition powder t fixed thereto (the web-shaped member 30 onto which the thermoplastic composition powder t has been fixed by the first unit 80 of FIG. 9A) is conveyed through a roller 48 to the nip N2 between the heat and pressure roller 40 and the peeling member forming member 2' having the organic polymer compound layer 18 formed at its surface. When the web-shaped member 30' is held and conveyed in the nip N3, the thermoplastic composition powder t on the surface of the web-shaped member 30' is softened by the heat and pressure applied by the heat and pressure roller 40 having the built-in heating halogen lamp 41 so as to adhere onto the organic polymer compound layer 18 of the rotating peeling member forming member 2'.

The web-shaped member 30', having the thermoplastic composition powder t on its surface adhering to the organic polymer compound layer 18 of the peeling member forming member 2', is separated from the peeling member forming member 2' by a roller 49 while being naturally cooled after passing through the nip N2. At this point, the thermoplastic composition formed on the web-shaped member 30' is transferred onto the organic polymer compound layer 18 of the peeling member forming member 2', and the separated web-shaped member 30' is wound up.

According to the method illustrated in FIGS. 9A and 9B, the web-shaped member 30' is used where the thermoplastic composition powder t continuously adheres to each section having a length corresponding to n times the perimeter of the peeling member forming member 2' (n is an integer greater than zero) with a blank part to which the thermoplastic composition powder t does not adhere being provided by exposure between one section and the next section as described above, and one section's worth of the thermoplastic composition powder t (the thermoplastic composition powder t on the section between one blank part and the next blank part) is transferred to a single roller-shaped peeling member forming member 2'. Thereby, it is possible to apply a fixed amount of the thermoplastic composition powder t evenly to the entire peripheral surface of the peeling member forming member 2'.

Further, in the case of providing the thermoplastic composition on the sheet-shaped member, the number of sheets to provide the thermoplastic composition layer of the peeling member with a necessary thickness may be, but is not limited to, one. That is, the thermoplastic composition may be provided on each of multiple sheets so that the thermoplastic composition is transferred from each of the multiple sheets to the same peeling member forming member 2' to form the peeling member (peeling roller). However, by providing the thermoplastic composition on a section of the sheet-shaped member having a length corresponding to the perimeter or the integral multiple of the perimeter of the peeling member forming member 2', it is also possible to obtain the peeling member (peeling roller) having a thermoplastic composition layer uniform in thickness with the sheet-shaped member.

Further, the charging operation by the charging roller 34 may be stopped at predetermined intervals in order to provide the above-described blank part, so that parts corresponding to blanks may be formed without using the exposure unit 43. In this case, however, the accuracy of the boundaries between blanks and parts to which the thermoplastic composition powder t adheres is poor. Accordingly, it is preferable to cause the thermoplastic composition powder t to adhere to the web-shaped or sheet-shaped member for a length corresponding to the perimeter or the integral multiple of the perimeter of the peeling member forming member 2' with the exposure by the exposure unit 43 as illustrated in FIG. 9A.

Further, it is advantageous to separately provide the first unit 80, which provides the web-shaped member 30 (or the sheet-shaped member 50 of FIG. 8) with a thermoplastic composition to be transferred to the peeling member forming member 2', and the second unit 81 configured to transfer the thermoplastic composition formed on the web-shaped member 30 (or the sheet-shaped member 50) to the peeling member forming member 2' as illustrated in FIGS. 9A and 9B because this obviates the necessity for the first and second units 80 and 81 to perform their respective processes described above at the same time or in the same place. For example, a manufacturer may manufacture the web-shaped member 30 (or the sheet-shaped member 50) provided with a thermoplastic composition using the first unit 80 in a factory or the like. Then, in the image remover 1 of FIG. 1 used by a user before its shipment, the peeling member forming member 2' may be set in place of the peeling roller 2, and thereafter, the thermoplastic composition layer 19 may be provided on the peeling member forming member 2' by conveying the web-shaped member 30 (or the sheet-shaped member 50) provided with the thermoplastic composition as in the second unit 81, so that the peeling roller 2 can be obtained.

In particular, the image remover provided in the image forming and removing system described below may be used directly or with partial modification as the first unit 80 configured to provide the web-shaped member 30 (or the sheet-shaped member 50) with a thermoplastic composition to be transferred to the peeling member forming member 2'. Likewise, the image remover provided in the image forming and removing system described below may be used directly or with partial modification as the second unit 81 configured to transfer the thermoplastic composition formed on the web-shaped member 30 (or the sheet-shaped member 50) to the peeling member forming member 2'. Further, reusable recording material used in the image forming and removing system according to one embodiment of the present invention may be used directly as the web-shaped member 30 (or the sheet-shaped member 50). Thus, there is no need to prepare a particular apparatus for providing the peeling member forming member 2' with a thermoplastic composition layer.

Accordingly, for example, the peeling member forming member 2' may be set in place of the peeling roller 2 in such an image remover used by a user as illustrated in FIG. 1 before its shipment, and the user, a supplier of the image remover, or a serviceman may use an image forming apparatus used by the user and reusable recording material so as to form a solid image corresponding to the thermoplastic composition layer on the reusable recording material. Then, the reusable recording material having the solid image formed thereon is passed through the nip between the peeling member forming member 2' and the heat and pressure roller of the image remover, so that the thermoplastic composition layer is formed on the peeling member forming member 2'. Thereby, the peeling roller 2 can be manufactured with ease at low cost.

The thermoplastic composition layer 19 may be provided at the outermost surface of the peeling member 2 by applying a thermoplastic composition dissolved in an organic solvent to the peeling member forming member 2' formed up to the organic polymer compound layer 18, or by charging the peeling member forming member 2', causing a thermoplastic composition in the form of powder to adhere to the charged peeling member forming member 2', and thereafter, softening and melting the thermoplastic composition by applying heat thereto. However, these manufacturing methods require a special apparatus or jig for providing the thermoplastic composition in manufacturing the peeling roller. On the other hand, according to the method of manufacturing the peeling roller 2 of this embodiment, the peeling roller 2 having the thermoplastic composition layer 19 formed at its outermost surface can be manufactured with ease at low cost by transferring thermoplastic composition powder transferred to the surface of the web-shaped member 30 (or the sheet-shaped member 50) to the peeling member forming member 2 through application of heat and pressure as described above. That is, reusable recording material used by a user may be used directly as the web-shaped member 30 (or the sheet-shaped member 50) to which the thermoplastic composition is transferred.

Further, if an image forming substance used for the image forming apparatus used by a user is used directly as the thermoplastic composition, the image forming apparatus used by a user may be used directly or with slight modification as an apparatus for providing the web-shaped member 30 (or the sheet-shaped member 50) with the thermoplastic composition. Further, such an image remover used by a user as illustrated in FIG. 1 may be used directly or with slight modification as an apparatus or unit for transferring a material layer formed on the web-shaped member 30 (or the sheet-shaped member 50) to serve as the thermoplastic composition layer 19 to the peeling member forming member 2'. Accordingly, there is no need to prepare a special apparatus or jig and no organic solvent is used in manufacturing the above-described peeling roller 2 of this embodiment. Therefore, it is possible to solve safety and health problems and the problem of manufacturing costs. Further, there is no occurrence of the safety and health problem of powder scattering.

Second Embodiment

Figure 10:
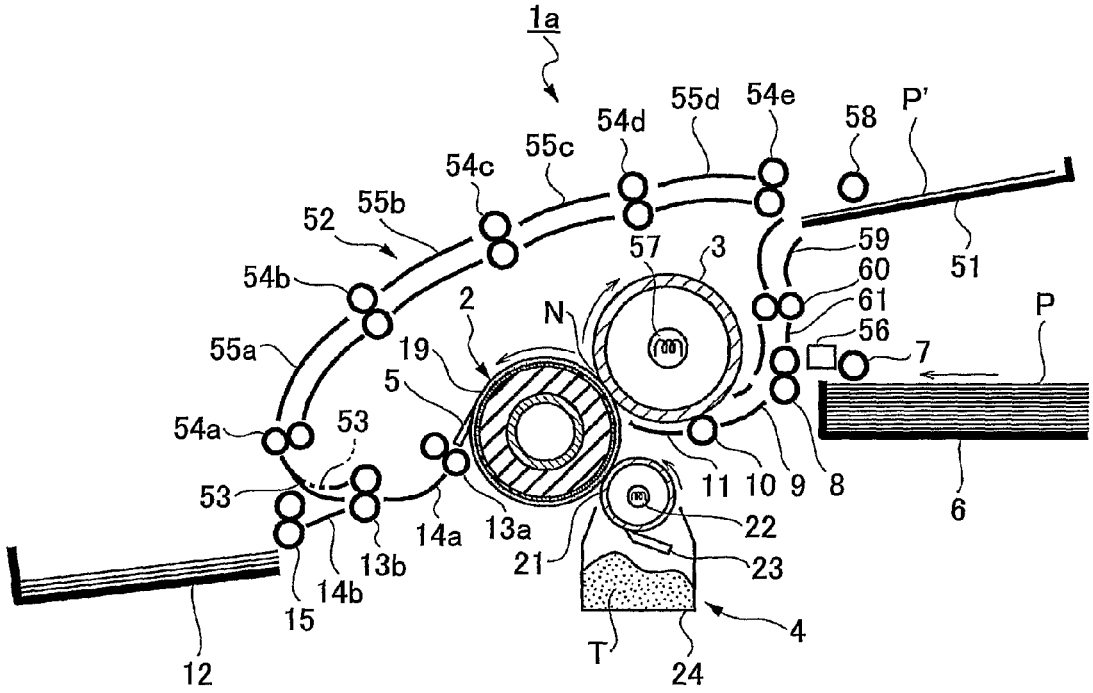
FIG. 10 is a diagram illustrating an image remover including the peeling roller as a peeling member according to a second embodiment of the present invention.

FIG. 10 is a schematic diagram showing a configuration of an image remover 1*a* having the peeling roller 2 used as a peeling member according to a second embodiment of the present invention. In the below-described image remover 1*a* according to the second embodiment of the present invention, like components are denoted by like reference numerals as of the image remover 1 according to the first embodiment of the present invention and are not further explained.

As shown in FIG. 10, the image remover 1*a* according to an embodiment of the present invention includes an inverted conveyance part 52. In a case where an image is formed on each side of the recording material P, the inverting conveyance part 52 is configured to invert the recording material P and convey the recording material P to a temporary storage tray 51 instead of conveying the recording material P to the paper discharge tray 12 after an image (image forming substance) on one side of the recording material P is removed. The inverted conveyance part 52 includes an oscillatable inverting guide plate 53, plural pairs of conveyance rollers 54*a*, 54*b*, 54*c*, 54*d*, 54*e* rotated by a drive unit (not graphically illustrated), and plural pairs of guide plates 55*a*, 55*b*, 55*c*, 55*d*. The same as the first embodiment of the present invention, the recording material P according to the second embodiment of the present invention is a reusable recording material.

An optical image sensor 56 having a light emitting part and a light receiving part is provided in the vicinity of the paper feed roller 7 of the paper feed cassette 6. A control unit (not graphically illustrated) oscillates the inverting guide plate 53 according to a detection signal from the image sensor 56. In a case where the image sensor 56 determines that an image is formed on only one side of the recording material P (a case where the image sensor 56 determines that no image is formed on an upper face of the recording material P set on the paper feed cassette 6), the control unit oscillates the inverting guide plate 53 to a standby position (position illustrated with a broken line in FIG. 10). In a case where the image sensor 56 determines that an image is formed on each side of the recording material P (a case where the image sensor 56 determines that an image is formed on the upper face of the recording material P set on the paper feed cassette 6), the control unit oscillates the inverting guide plate 53 to an inverted conveyance position (position illustrated with a solid line in FIG. 10) after an image removal operation is performed on one side of the recording material P.

In a case where a recording material P having an image formed on one of its sides is set on the paper feed cassette 6, the image remover la separates the recording material P from the thermoplastic composition layer 19 of the peeling roller 2 by using the separation member 5 after the recording material P passes through the nip N in the same manner as the image remover 1 of above-described first embodiment of the present invention. When the recording material P is separated from the peeling roller 2, the image forming substance on the recording material P remains only on the peeling roller 2, and the image forming substance on the recording material P is removed. The separated recording material P is discharged onto the paper discharge tray 12 through a pair of conveyance rollers 13*a*, a guide plate 14*a*, another pair of conveyance rollers 13*b*, another guide plate 14*b*, and a pair of paper discharge rollers 15. At this stage, the inverting guide plate 53 is in the standby position (position illustrated with a broken line in FIG. 10).

In a case where a recording material P having an image formed on each side is set on the paper feed cassette 6, the inverting guide plate 53 is oscillated to the inverted conveyance position (position illustrated with a solid line in FIG. 10) when the image sensor 56 detects that an image is formed on each side of the recording material P, to thereby perform the image removal operation on one side of the recording material P. Then, the recording material P is conveyed to the inverting guide plate 53 through the pair of conveyance rollers 13*a*, the guide plate 14*a*, and the other pair of conveyance rollers 13*b*. Then, the recording material P is inverted (indicated as recording material P' in FIG. 10) by the inverting guide plate 53 and discharged to the temporary storage tray 51 through the plural pairs of conveyance rollers 54*a*-54*e* and the plural pairs of guide plates 55*a*-55*d*. A paper feed roller 58 can be temporarily moved so as not to obstruct the inverted recording material P' discharged onto the temporary storage tray 51. When the inverted recording material P' is discharged onto the temporary storage tray 51, the other side of the recording medium P' having an image formed thereto is faced downward.

The recording material P' on the temporary storage tray 51 is automatically fed by the paper feed roller 58 and conveyed again to the nip N through a pair of guide plates 59, a pair of conveyance rollers 60, a pair of guide plates 61, another pair of guide plates 9, a conveyance roller 10, and the guide plate 11. In the same manner as the first embodiment of the present invention, the image remover la separates the recording material P' from the thermoplastic composition layer 19 of the peeling roller 2 by using the separation member 5 after the recording material P' passes through the nip N. When the recording material P' is separated from the peeling roller 2, the image forming substance on the recording material P' remains only on the peeling roller 2, and the image forming substance on the recording material P' is removed. The separated recording material P' is discharged onto the paper discharge tray 12 through the pair of conveyance rollers 13*a*, the guide plate 14*a*, the other pair of conveyance rollers 13*b*, the other guide plate 14*b*, and the pair of paper discharge rollers 15. At this stage, the inverting guide plate 53 is in the standby position (position illustrated with a broken line in FIG. 10).

With the above-described embodiment of the image remover 1*a*, even in a case where an image is formed on each side of the recording material P, the image formed on each side of the recording material P can be automatically reliably removed with efficiency. Furthermore, even in a case where a user inadvertently sets a recording material P having an image formed only on one side of the recording material P on the paper feed cassette 6 in a manner having the image facing upward, the image can be removed from the recording material P by conveying the recording material P to the nip N after the recording material P is inverted and conveyed to the temporary storage tray 51. This reduces the user's workload of setting every recording material P facing the correct direction on the paper feed cassette 6.

Third Embodiment

Figure 11:
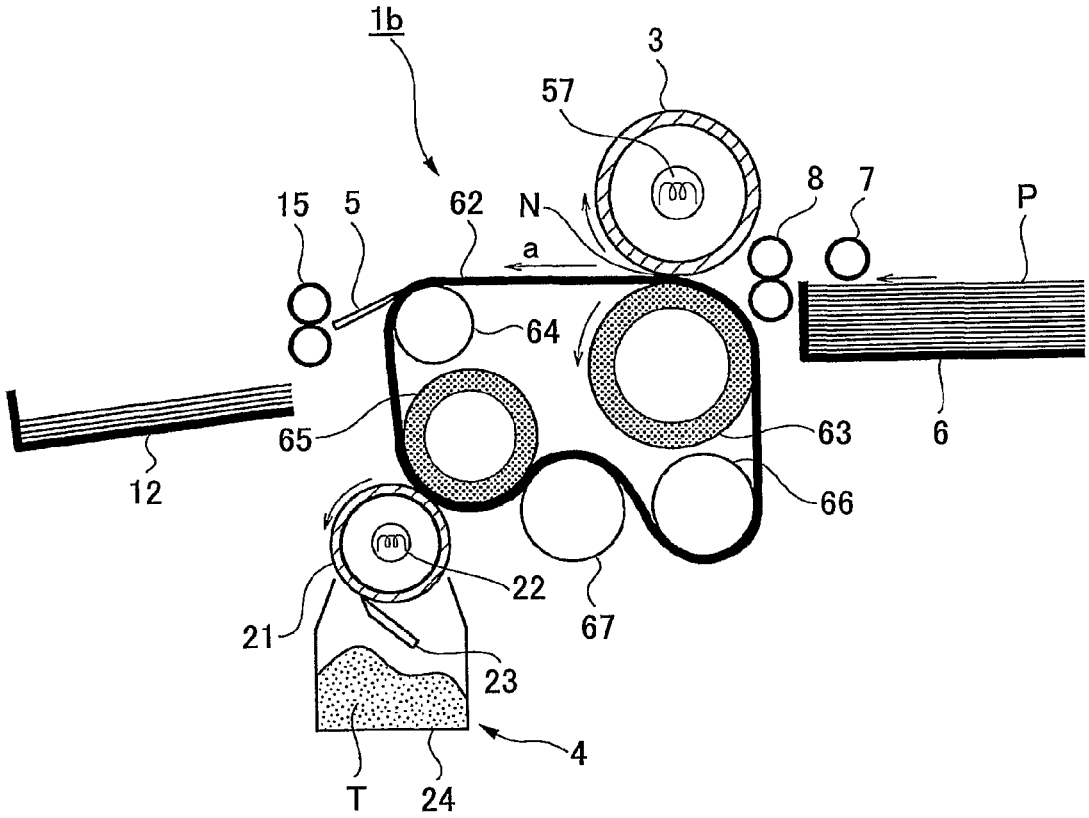
FIG. 11 is a diagram illustrating an image remover including a peeling belt as a peeling member according to a third embodiment of the present invention.

FIG. 11 is a schematic diagram showing a configuration of an image remover 1*b* having an endless peeling belt 62 used as a peeling member according to a third embodiment of the present invention. In the below-described image remover 1*b* according to the third embodiment of the present invention, like components are denoted by like reference numerals as of the image removers 1 and 1*a* according to the first and second embodiments of the present invention and are not further explained.

As shown in FIG. 11, the image remover 1*b* according to an embodiment of the present invention has the endless peeling belt 62 spanning around a driving roller 63, a separation roller 64, an opposing roller 65, and a driven roller 66. A tension roller 67 contacting the outer surface of the peeling belt 62 provides a predetermined tension to the peeling belt 62. In this embodiment of the present invention, the separation roller 64 and the opposing roller 65 function as driven rollers. The peeling belt 62 is moved in a direction illustrated with arrow "a" (arrow direction "a") in FIG. 11 by the rotation of the driving roller 63 connected to a driving source (not graphically illustrated).

The driving roller 63 is provided in a position opposing the heat and pressure roller 3 having the peeling belt 62 sandwiched therebetween. The heat and pressure roller 3 has a heating halogen lamp 57 installed therein. The peeling belt 62 is moved in the arrow direction "a" by friction generated at the nip N between the driving roller 63 and the heat and pressure roller 3. The driving roller 63 is configured having a heat-resistant elasticity layer formed on a base body. The base body is formed of a metal material such as stainless steel or aluminum. The heat-resistant elasticity layer is formed of, for example, silicon rubber or a foamed silicon rubber elastic material having a thickness of approximately 0.5 mm to 10 mm and a rubber hardness of 10° to 50°.

A pressure applicator (not graphically illustrated) that applies a predetermined pressure to the driving roller 63 (peeling belt 62) through a spring force is connected to the heat and pressure roller 3 so as to apply pressure so that the nip N between the driving roller 63 and the heat and pressure roller 3 has a predetermined nip width. The same as the first embodiment of the present invention, the surface of the heat and pressure roller 3 is coated with, for example, polytetrafluoroethylene or perfluoroalkylvinylether resin.

At a curved part of the peeling belt 62 where the separation member 5 faces the separation roller 64, the separation member 5 is provided at a predetermined angle having its tip (end part) in substantial contact with the outer surface of the peeling belt 62. At a position where the tip (end part) of the separation member 5 is in substantial contact with the surface of the peeling belt 62, the cleaning roller 21 of the cleaning roller 4 is provided in contact with the outer surface of the peeling belt 62.

Figure 12:
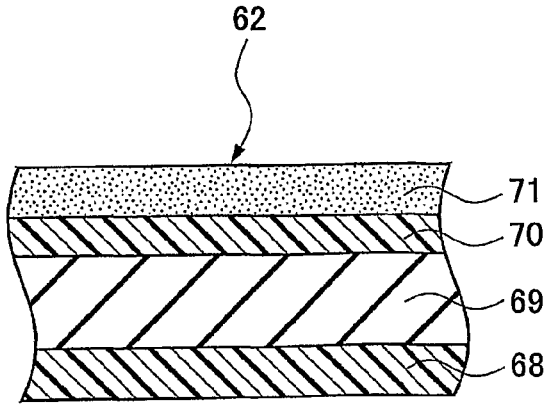
FIG. 12 is a cross-sectional view of the peeling belt according to the third embodiment of the present invention.

As shown in FIG. 12, the peeling belt 62 has a flexible base body 68 on which a rubber elasticity layer 69, an organic polymer compound layer 70, and a thermoplastic compound layer 71 are layered in this order. The base body 68 is formed by molding a film into an endless belt shape with a thickness of 50 μm to 300 μm. The film of the base body 68 is formed of a highly heat resistant organic polymer material such as polyethylene terephthalate, polyethylene naphthalate, polysulfone, polyetherimide, polyamideimide, polyamide, polyphenylene sulfide, polyimide, polyether ether ketone, and polyethersulfonepolyimide.

The rubber elastic layer 69, the organic polymer compound layer 70, and the thermoplastic compound layer 71 are formed with the same materials as the rubber elasticity layer 17, the organic polymer compound layer 18, and the thermoplastic compound layer 19, respectively, of the peeling roller 2 according to the first embodiment of the present invention.

(Image Removing Method)

Next, a method of removing an image from a recording material having the image formed with an image forming substance by using the above-described image remover 1*b* is described.

As shown in FIG. 11, multiple sheets of the recording material P are loaded in the paper feed cassette 6 with their surfaces having images formed thereon facing downward. The image on the recording material P formed of an image forming substance is, for example, formed by an image forming operation by an image forming apparatus such as a known electrophotographic copier. In this embodiment, the above-described reusable recording material is used as the recording material P.

The recording material P is fed sheet by sheet by the rotation of the paper feed roller 7, and the fed recording material P is conveyed to the nip N between the peeling belt 62 and the heat and pressure roller 3 through the conveyance rollers 8. When the recording material P heated by the heating halogen lamp 57 is held and conveyed in the nip N having a predetermined width, the image forming substance on the recording material P and the thermal plastic compound layer 71 (See FIG. 12) of the peeling belt 62 are heated, and the thermoplastic composition layer 71 softened into a plastic state at the outermost surface of the peeling belt 62 is pressed against the image forming substance forming the image on the recording material P. As a result, the image forming substance on the recording material P adheres to the thermoplastic composition layer 71 of the peeling belt 62.

Then, the recording material P moves toward the separation member 5 with the moving of the peeling belt 62 while adhering to the thermoplastic composition layer 71 of the peeling belt 62. At this point, since the rubber elasticity layer 69 of the peeling belt 62 is formed of rubber material having low thermal conductivity so as to be able to function as a heat insulating layer, only the temperatures of the recording material P at the nip N and the vicinity of the surface of the peeling belt 62 rise. Thus, since the heated parts have a relatively low thermal capacity, the heated parts are rapidly cooled after the recording material P passes through the nip N. Thereby, the cohesion of the thermoplastic composition layer 71 of the peeling belt 62 and the image forming substance on the recording material P increases.

As a result, it is possible to cause the separation member 5 to contact the recording material P, so that the recording material P is satisfactorily separated from the thermoplastic composition layer 71 of the peeling belt 62 by the separation member 5. When the recording material P is separated from the peeling belt 62, the image forming substance remains only on the peeling belt 62, and the image forming substance on the recording material P is removed. The separated recording material P is discharged onto the paper discharge tray 12 through the paper discharge rollers 15.

Further, the image forming substance thermally transferred onto the thermoplastic composition layer 71 of the peeling belt 62 is transferred onto the surface of the cleaning roller 21 of the cleaning unit 4, which cleaning roller 21 is rotated at a peripheral speed 1.2 to 10 times the peripheral speed of the peeling belt 62, so that the thermoplastic composition layer 71 of the peeling belt 62 is cleaned, having the image forming substance removed therefrom. Further, an appropriate gap maintaining mechanism (not graphically illustrated) is provided between the cleaning roller 21 and the peeling belt 62 in order to keep constant the thickness of the thermoplastic composition layer 71 of the peeling belt 62. For example, the gap between the peeling belt 62 and the cleaning roller 21 is maintained so as to be able to keep constant the thickness of the thermoplastic composition layer 71 of the peeling belt 62 by providing a ring or an annular step (not graphically illustrated) contacting the organic polymer compound layer 70 of the peeling belt 62 to the shaft part of the cleaning roller 21 so that a gap is maintained between the cleaning roller 21 and the organic polymer compound layer 70 of the peeling belt 62.

The cleaning roller 21 can satisfactorily transfer the heated image forming substance from the thermoplastic composition layer 71 of the peeling belt 62 onto the surface of the cleaning roller 21 by being heated to a predetermined temperature by controlling energization of the heating halogen lamp 22. The image forming substance transferred onto the surface of the cleaning roller 21 is taken off by the cleaning blade 23, and taken-off image forming substance T is collected into the collection container 24.

Fourth Embodiment

Figure 13:
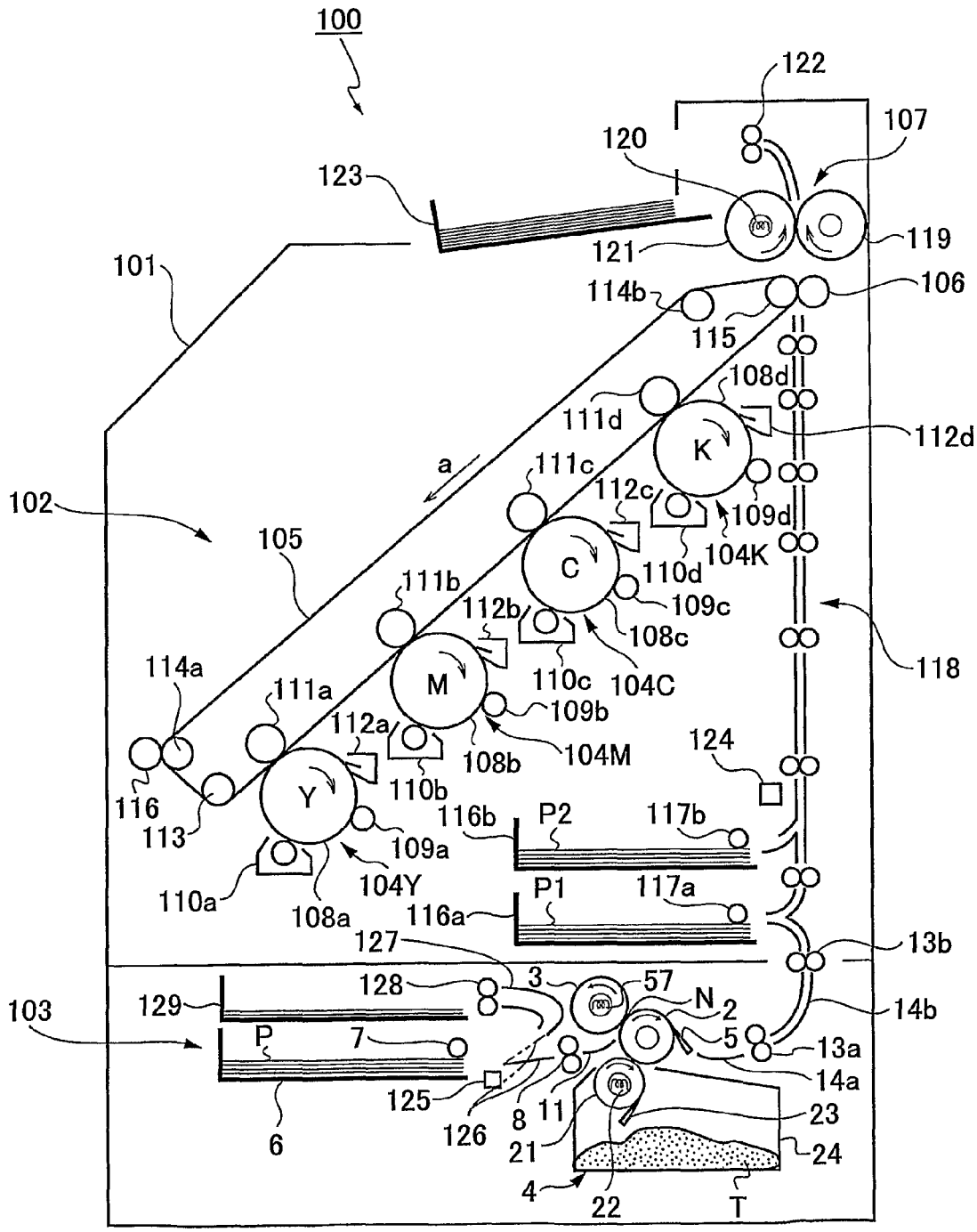
FIG. 13 is a diagram illustrating an image forming and removing system according to a fourth embodiment of the present invention.

FIG. 13 is a schematic diagram showing an image forming and removing system according to a fourth embodiment of the present invention.

As shown in FIG. 13, the image forming and removing system 100 according to an embodiment of the present invention includes an image forming apparatus 102 for performing an image forming process on a recording material P at an upper part of its housing 101 and an image remover 103 for removing an image formed on the recording material P by the image forming apparatus 102 at a part below the image forming apparatus 102. The image forming apparatus 102 according to an embodiment of the present invention is a known electrophotographic tandem type color image forming apparatus having four image forming parts. The image remover 103 according to an embodiment of the present invention is an image remover having the peeling roller 2 as described in the first embodiment of the present invention.

(Configuration of Image Forming Apparatus 102)

The image forming apparatus 102 includes: an alignment of four image forming parts 104Y, 104M, 104C, and 104K for forming toner images of yellow, magenta, cyan, and black; an endless intermediate transfer belt 105 on which the yellow, magenta, cyan, and black toner images are superposed and transferred to form a full color toner image (first transfer); a second transfer roller 106 for transferring the full color toner image on the intermediate transfer belt 105 onto the recording material P (second transfer); and a fixing unit 107 for fixing the full color toner image transferred from the second transfer roller 106 onto the surface of the recording material P.

The image forming parts 104Y, 104M, 104C, and 104K include: photoconductor drums 108*a*, 108*b*, 108*c*, 108*d*;

charging rollers 109*a*, 109*b*, 109*c*, 109*d*; developers 110*a*, 110*b*, 110*c*, 110*d*; first transfer rollers 111*a*, 111*b*, 111*c*, 111*d*; and cleaning units 112*a*, 112*b*, 112*c*, 112*d*, respectively. The developers 110*a*, 110*b*, 110*c*, and 110*d* of the image forming parts 104Y, 104M, 104C, and 104K contain a thermoplastic image forming substance (toner) containing wax components corresponding to yellow, magenta, cyan, and black colors, respectively.

The intermediate transfer belt 105 spans around a driving roller 113, driven rollers 114*a*, 114*b*, and an opposing roller 115. The intermediate transfer belt 105 is moved in a direction illustrated with arrow "a" (arrow direction "a") in FIG. 13 by the rotation of the driving roller 113. The intermediate transfer belt 105 moves through the nips between the photoconductor drums 108*a*, 108*b*, 108*c*, 108*d* and corresponding first transfer rollers 111*a*, 111*b*, 111*c*, 111*d*. A cleaning roller 116 is provided in contact with an outer surface of the intermediate transfer belt 105 at a position facing the driven roller 114*a*. The second transfer roller 106 is also provided in contact with the outer surface of the intermediate transfer belt 105 at a position facing the opposing roller 115.

(Image Forming Operation)

Next, an embodiment of an image forming operation using the image forming apparatus 102 is described.

The charging rollers 109*a*, 109*b*, 109*c*, 109*d* evenly charge the surfaces of the photoconductor drums 108*a*, 108*b*, 108*c*, 108*d* rotating in the direction of an arrow (clockwise in FIG. 13) at a predetermined processing speed. Then, laser beams are irradiated from an exposing unit (not graphically illustrated) to the surfaces of the photoconductor drums 108*a*, 108*b*, 108*c*, 108*d*, to thereby form electrostatic latent images corresponding to input image data.

Then, the developers 110*a*, 110*b*, 110*c*, and 110*d* develop (make visible) the electrostatic latent images formed on the surfaces of the photoconductor drums 108*a*, 108*b*, 108*c*, 108*d* by adhering thermoplastic image forming substances (toner) of corresponding yellow, magenta, cyan, and black colors thereto. Thereby, a toner image of yellow, a toner image of magenta, a toner image of cyan, and a toner image of black are formed on the surface of corresponding photoconductor drums 108*a*, 108*b*, 108*c*, and 108*d*.

Then, the toner images of each color are successively transferred onto the moving intermediate transfer belt 105 in a superposed manner by the first transfer rollers 111*a*, 111*b*, 111*c*, and 111*d* having transfer bias applied thereto. Thereby, a full color toner image is formed on the intermediate transfer belt 105. Along with the forming of the full color toner image, the recording material P is fed from a paper feed tray 116*a* (or a paper feed tray 116*b*) to a conveyance part 118 by a paper feed roller 117*a* (or a paper feed roller 117*b*). The paper feed tray 116*a* is for mounting reusable recording material P1 whereas the paper feed tray 116*b* is for mounting regular recording material P2 (recording material other than reusable recording material such as plain paper). Then, the conveyance part 118 having plural pairs of conveyance rollers and plural pairs of conveyance guides conveys the recording material P to a second transfer part positioned between the intermediate transfer belt 105 and the second transfer roller 106, to thereby have the full color toner image transferred onto the recording material P.

Then, the recording material P having the toner image transferred thereto is conveyed to the fixing unit 107 including a pressure roller 119 and a fixing roller 121 having a heating halogen lamp 120 installed therein. By conveying the recording material P through a fixing nip between the pressure roller 119 and the fixing roller 121, the toner image is fixed onto the recording material P. The fixing unit 107 is an oil-less fixing unit that does not apply oil as a release agent to the fixing roller. The recording material P having the toner image fixed thereon is discharged onto a paper discharge tray 123 through a pair of paper discharge rollers. The image forming apparatus 102 is not only able to perform the above-described image forming operation of transferring and fixing a full color toner image onto the recording material P but is also able to perform an image forming operation of transferring and fixing a monochrome toner image onto the recording material P according to the user discretion by driving the image forming part 104K.

As described above, the image forming apparatus 102 has two paper feed trays 116*a* and 116*b*. According to an embodiment of the present invention, the recording material P1, which is set in the paper feed tray 116*a*, is reusable recording material formed by adding a composition that reduces adhesion with respect to an image forming substance whereas the recording material P2, which is set in the paper feed tray 116*b*, is regular recording material (plain paper). The user can select between a first mode for performing an image forming operation on a reusable recording material P1 or a second mode for performing an image forming operation on a regular recording material P2 by using a control panel (not graphically illustrated) of the image forming apparatus 102 or a user interface shown in a display of a computer (not graphically illustrated) connected to the image forming apparatus 102.

In using the above-described control panel or the interface, the first mode is selected by touching buttons and choices indicated as "reuse", "paper reuse", "reuse mode", "dedicated paper", "recycled paper", "resource saving", "short-period browsing", or "short-period use", for example. The second mode is selected by touching buttons and choices indicated as "fixing mode", "high fixing", "fix mode", "plain paper", "new paper", "document storage" and "external distribution", for example.

Accordingly, when the user selects the first mode, a reusable recording material P1 is fed from the paper feed cassette 116*a*, to thereby form an image (color image) on the reusable recording material P1. On the other hand, when the user selects the second mode, a regular recording material P2 is fed from the paper feed cassette 116*b*, to thereby form an image (color image) on the regular recording material P2. Identification data (not graphically illustrated) (e.g., a notch, a hole, or a printed barcode) are provided on the reusable recording material P1 beforehand for indicating that the recording material P mounted on the paper feed cassette 116*a* is a reusable recording material P1.

An optical detection sensor 124 having a light emitting part and a light receiving part is provided at a portion of the conveyance part 118 corresponding to the paper feed cassette 116*a* for detecting whether the recording material P has the identification data. Therefore, in a case where a regular recording material P2 is inadvertently mounted in the paper feed cassette 116*a*, the detection sensor 124 does not detect the above-described identification data. In this case, a control part (not graphically illustrated) may stop the image forming operation or discharge a recording material (e.g., plain paper) onto the paper discharge tray 123 without transferring an image onto the recording material in accordance with a signal from the detection sensor 124.

(Configuration of Image Remover 103)

The image remover 103 mounted in the image forming and removing system 100 according to an embodiment of the present invention has substantially the same configuration as that of the image remover 1 according to the first embodiment of the present invention. In the below-described image remover 103 according to the fourth embodiment of the present invention, like components are denoted by like reference numerals as of the image remover 1 according to the first embodiment of the present invention and are not further explained. In this embodiment, the above-described reusable recording material is used as the recording material P.

Referring to FIG. 13, the image remover 103 according to this embodiment includes the peeling roller 2 rotatably supported to serve as a peeling member; a heat and pressure roller 3 rotatably supported in contact with the peeling roller 2, the heat and pressure roller 3 including the heating halogen lamp 57; a cleaning unit 4 that cleans the surface of the peeling roller 2; and a separation member 5 for separating from the peeling roller 2 reusable recording material P adhering to the surface of the peeling roller 2 because of heating and pressing in a nip N between the peeling roller 2 and the heat and pressure roller 3.

An optical detection sensor 125 having a light emitting part and a light receiving part is provided at a front side of the paper feed cassette 6 containing the reusable recording material P. The optical detection sensor 125 is for determining whether there is any identification data applied to the recording material P for identifying (distinguishing) reusable recording material P.

(Image Removing Operation)

In the image remover 103 according to an embodiment of the present invention, when the reusable recording material P is conveyed by the paper feed roller 7 from the paper feed cassette 6 in a manner where the image formed on the reusable recording material P is faced downward, the detection sensor 125 detects the identification data formed on the reusable recording material P. Then, when a control part (not graphically illustrated) determines that the conveyed recording material P is reusable recording material according to a signal from the detection sensor 125, the reusable recording material P is conveyed to the nip N between the peeling roller 2 and the heat and pressure roller 3 through a guide plate 126, the pair of guide rollers 8, and another guide plate 11.

When the reusable recording material P heated by the heating halogen lamp 57 is held and conveyed in the nip N, the thermoplastic composition layer softened into a plastic state at the outermost surface of the peeling roller 2 is pressed against the image forming substance on the reusable recording material P. As a result, the image forming substance on the recording material P adheres to the thermoplastic composition layer of the peeling roller 62.

At this point, since the rubber elasticity layer of the peeling roller 2 is formed of rubber material having low thermal conductivity so as to be able to function as a heat insulating layer, only the temperatures of the reusable recording material P at the nip N and the vicinity of the surface of the peeling roller 2 rise. Thus, since the heated parts have a relatively low thermal capacity, the heated parts are rapidly cooled after the reusable recording material P passes through the nip N. Thereby, the cohesion of the thermoplastic composition layer of the peeling roller 2 and the image forming substance on the reusable recording material P increases.

As a result, it is possible to cause the separation member 5 to contact the reusable recording material P, so that the recording material P is satisfactorily separated from the thermoplastic composition layer of the peeling roller 2 by the tip of the separation member 5. When the reusable recording material P is separated from the peeling roller 2, the image forming substance remains only on the peeling roller 2, and the image forming substance on the reusable recording material P is removed. The separated reusable recording material P is discharged onto the paper feed cassette 116*a* provided in the image forming apparatus 102 through the guide plate 14*a*, the pair of conveyance rollers 13*a*, the guide plate 14*b*, and the pair of conveyance rollers 13*b*. At this point, the paper feed roller 117*a* of the paper feed cassette 116*a* is temporarily moved.

The reusable recording material P discharged onto the paper feed cassette 116*a* is fed during an image forming operation by the image forming apparatus 102. After a color image is transferred and fixed onto the reusable recording material P by the image forming operation, the reusable recording material P is discharged onto the paper discharge tray 123. Then, by returning this reusable recording material P having the image formed thereon back to the paper feed cassette 6 provided in the image remover 103, the image can be removed again by the image remover 103.

Further, the image forming substance thermally transferred onto the thermoplastic composition layer of the peeling roller 2 is transferred onto the surface of the cleaning roller 21 of the cleaning unit 4, which cleaning roller 21 is rotated at a peripheral speed 1.2 to 10 times the peripheral speed of the peeling roller 2, so that the thermoplastic composition layer of the peeling roller 2 is cleaned, having the image forming substance removed therefrom. At this point, the cleaning roller 21 can satisfactorily transfer the heated image forming substance from the thermoplastic composition layer of the peeling roller 2 onto the surface of the cleaning roller 21 by being heated to a predetermined temperature by controlling energization of the heating halogen lamp 22. The image forming substance transferred onto the surface of the cleaning roller 21 is taken off by the cleaning blade 23, and taken-off image forming substance T is collected into the collection container 24.

Accordingly, with the above-described embodiment of the image forming and removing system 100, an operation of forming an image on a single reusable recording material P at the image forming apparatus 102 and removing the image from the reusable recording material P at the image remover 103 can be performed multiple times.

In a case where a regular recording material P (plain paper) is inadvertently loaded in the paper feed cassette 6, the detection sensor 125 does not detect the above-described identification data. Thus, a control part (not graphically illustrated) determines that the regular recording material P (plain paper) is not reusable recording material P according to a signal from the detection sensor 125 and oscillates the guide plate 126 toward the pair of guide plates 127 (position illustrated with a broken line in FIG. 13). Then, the regular recording material P (plain paper) is discharged onto a paper discharge tray 129 through the guide plate 126, the pair of guide plates 127, and a pair of discharge rollers 128. Accordingly, even in a case where a regular recording material P is inadvertently loaded in the paper cassette 6, the regular recording material P is discharged onto the paper discharge tray 129 without the image removing operation being performed on the regular recording material P.

Hence, since the above-described embodiment of the image forming and removing system is configured having the combination of the image remover including the peeling member and the image forming apparatus using a predetermined image forming substance, a consistent image removing characteristic and a consistent separating characteristic between the peeling member and the reusable recording material can be attained.

That is, the separation between the peeling roller 2 and the reusable recording material P in the image remover 103 according to the embodiment of the present invention depends on the type of release agent (wax) or amount of added release agent (wax) contained in the thermoplastic compound layer serving as the outermost layer of the peeling roller 2. Therefore, by making the type of release agent and added amount of release agent contained in the substance used for forming an image on the reusable recording material the same as those of the substance contained in the thermoplastic compound layer of the peeling roller 2 of the image remover 103, the type of release agent and added amount of release agent contained in the thermoplastic compound layer of the peeling roller 2 would not change even if the image removing operation were performed on plural reusable recording materials P for multiple times by the image remover 103. Therefore, the separation resistance generated when separating the reusable recording material from the surface of the peeling roller 2 is consistent. Thus, a stable separating characteristic can be attained.

In order to attain a consistent adhering strength for the reusable recording material P with respect to the image forming substance, a predetermined substance is also used for the reusable recording material P in the image forming and removing system 100 according to an embodiment of the present invention. Thereby, a stable image removing characteristic and a stable separating characteristic between the peeling roller 2 and the reusable recording material P can be attained.

Furthermore, according to an embodiment of the present invention, a reusable recording material P having an image formed thereon is loaded on the paper feed cassette 6 of the image remover 103 only when it is determined that the image is formed according to a first mode for forming an image on a reusable recording material. The determination is performed by recording data indicating that the image is formed according to the first mode and detecting the recorded data with the detection sensor 124 located at the vicinity of the conveying part 118 of the image forming apparatus 103. Hence, by loading the reusable recording material P on the paper feed cassette 6 of the image remover 3 only in a case where an image is formed on the reusable recording material P in the image forming apparatus 102 of the image forming and removing apparatus according to an embodiment of the present invention, a stable consistent separation resistance between the reusable recording material P and the peeling roller 2 can be attained. Further, jamming due to insufficient separation can be prevented. Further, damaging of the peeling roller 2 can be prevented. Further, a stable image removing characteristic with respect to a reusable recording material can be attained.

Furthermore, by enabling the image forming apparatus 102 to automatically restrict the use of a stapler function or a hole-punching function in a case of performing an image forming operation with the image forming apparatus 102 according to the first mode, jamming in the image remover 103 can be effectively prevented.

Consistent image removal and separation between a peeling member and a reusable recording material can be achieved by using an image remover having a peeling member in combination with a system including an image forming apparatus and a reusable recording material according to the above-described embodiment of the present invention, consistently using a predetermined reusable recording material, and using an image forming material (to be transferred to the peeling member) having a predetermined physical property and composition. Thereby, the image remover and the image forming apparatus according to the above-described embodiment of the present invention can maintain reliability for a long period.

Although the above-described embodiment of the image forming and removing system is illustrated as an image forming and removing system containing an image remover and an image forming apparatus inside a housing (united body), the same effects (advantages) can be attained where the image forming and removing system have the image remover and the image forming apparatus assembled to separate housings. The configuration of the image forming and removing system is not limited to that of the embodiments described above. For example, the image remover may be detachably attached to the image forming and removing system.

EXAMPLES

Next, a more specific description is given, with reference to the following examples (Examples 1 to 31), of the configuration of the peeling roller 2 as a peeling member according to the present invention, the configuration of the reusable recording material P, image formation, image removal (processing), evaluation of the image removal, etc. Additionally, comparative examples with respect to these examples are also illustrated (Comparative Examples 1 to 5).

Example 1

[Image Forming Substance]

Thermoplastic resin: a polyester resin (100 parts by weight);

Release agent: carnauba wax (4 parts by weight);

Charge control agent: zinc salicylate (1 part by weight); and

Coloring agent: carbon black (12 parts by weight).

The formulation described above was pre-kneaded with a mixer and the pre-kneaded material was melted and kneaded with a twin-roll mill.

Next, after being cooled, this kneaded material was roughly milled into 0.5 mm to 3 mm with a hammer mill, and was thereafter ground with a jet grinding machine and classified, so that a black toner with an average particle diameter of 7.1 μm was obtained. Then, 6 parts by weight of silica fine powder with an average particle diameter of 0.140 μm were mixed into 100 parts by weight of the obtained black toner, and the mixture was agitated with a Henschel mixer and screened, so that a black image forming substance was obtained. The softening temperature of the image forming material measured with a flow tester was 85° C.

The same operation as described above was performed except for using 6 parts by weight of C.I. Pigment Yellow 180, 7 parts by weight of C.I. Pigment Red 122, or 3.6 parts by weight of C.I. Pigment Blue in place of the carbon black in the formulation described above, so that yellow, magenta, and cyan image forming substances were obtained. The softening temperatures of these image forming substances were also 85° C.

[Configuration of Peeling Roller]

A shaft was fitted into a steel pipe member with a thickness of 3 mm, an outer diameter of 32 mm, and a width of 320 mm, thereby forming a roller-shaped core bar. Further, a polyimide tube with a thickness of 40 an outer diameter of 40 mm, and a width of 320 mm was manufactured by a centrifugal coating method. The above-mentioned polyimide tube and core bar were set in a mold. Raw materials of silicone rubber were poured between the core bar and the polyimide tube and cured. As a result, an unfoamed silicone rubber roller having a polyimide layer formed as an organic polymer compound layer and a rubber elastic layer with a thickness of 4 mm (corresponding to the peeling member forming member 2' as shown in FIG. 7 or FIG. 9B) was obtained (with a rubber hardness of 30 degrees according to JIS K6301A). The rubber used for the rubber elastic layer had a heat-conductivity of 0.35 W/mK.

The image forming substances manufactured as mentioned above and a carrier were mixed and loaded in the development unit of a commercially-available color electrophotographic image forming apparatus (imagio Neo C285 manufactured by Ricoh Company Ltd.). Then, releasing paper having silicone resin applied to each surface was prepared and set in the paper feed cassette of the above-mentioned imagio Neo C285, and a blue solid image was formed on the releasing paper.

Then, the unfoamed silicone rubber roller formed up to the polyimide layer (organic polymer compound layer) (corresponding to the peeling member forming member 2' as shown in FIG. 7 and FIG. 9B) was attached in place of the peeling roller 2 of the image remover 1 shown in FIG.1, and heating was performed with the temperature of the heat and pressure roller set at 130° C. Thereafter, the above-mentioned releasing paper having the blue and solid image formed thereon was caused to pass through the nip between them at a speed of 40 mm/s, so that the solid image on the releasing paper was completely transferred onto the surface of the unfoamed silicone rubber roller. Subsequently, releasing paper sheet having four solid images formed was caused to pass through the nip between them in the same manner, so that the solid images were all transferred onto the unfoamed silicone rubber roller. Thus, a peeling roller was obtained that had a 32 μm-thick thermoplastic composition layer formed of the image forming substances manufactured as described above at its outermost surface.

[Formation of Reusable Recording Material]

One part by weight of a 25 wt % aqueous solution of a saponified polymer of olefin—maleic anhydride and 10 parts by weight of a 10 wt % aqueous solution of polyvinyl alcohol were mixed to prepare a coating liquid. The coating liquid was applied to each side (surface) of commercially available plain paper (copy paper Type 6200 manufactured by Ricoh Company Ltd.) using a wire bar so that the amount of dry coating on each side was 2.3 g/m$^2$. Then, drying was performed at 120° C. for 5 minutes and a smoothing process was conducted with a super-calendar. As a result, reusable recording material was obtained.

A full color pattern having a gradation image, secondary color and monochromatic solid images, and character images was printed using the reusable recording material with the imagio Neo C285, and sharp images were printed.

[Repetition of Image Removal and Image Formation]

From the reusable recording material on which the image was formed as described above using the image remover 1 of FIG. 1 having the above-mentioned peeling roller, this image (image forming substance(s)) was removed. The conditions of image removal were as follows:

Process linear speed (peripheral speed of the peeling roller): 40 mm/s;

Preset temperature of the heat and pressure roller: 125° C.;

Pressure between the heat and pressure roller and the peeling roller: application of a force of 120 N on each end of the shaft of the peeling roller;

Rotational angle a from the exit of the nip to a separation position (FIG. 6): 120 degrees;

Separation angle θ of a separation member (FIG. 5): 20 degrees;

Preset temperature of a cleaning roller: 145° C.; and

Peripheral speed of a cleaning roller: 260 mm/s.

On these conditions, the image (made of image forming substances) on the reusable recording material was removed completely. Furthermore, when a cycle of conducting image removal after an image with a pattern identical to the above-mentioned one was formed again was repeated 10 times for the reusable recording material from which the image was removed, the obtained image was as sharp as the first obtained image during times of use without a significant change or an increase in the density of background fogging.

Moreover, the result of the image removal processing performed on the image forming substance on the reusable recording material after 10 times of repeated use was similar to the case of the first image forming substance removal processing and toner on the reusable recording material, which included a low-density gradation image, toner scattered on the periphery of the image, and post-removal fogging toner, were completely removed.

Furthermore, when running of the image remover was continued and an image forming substance removing process was conducted for 2000 sheets of reusable recording material on which images were formed, toner on the reusable recording material, which included low-density gradation images, toner scattered on the periphery of the images, and post-removal fogging toner, were removed completely the same as in the initial running.

Meanwhile, as a temperature range was evaluated in which separation between the reusable recording material and the peeling roller was allowed and an image could be removed completely even when the preset temperature of the heat and pressure roller was changed, it was impossible to remove an image completely at a temperature lower than about 117° C. and it was difficult to separate the reusable recording material and the peeling roller at a temperature higher than about 133° C. That is, the range of the preset temperature of the heat and pressure roller in which both separation between the reusable recording material and the peeling roller and removal of an image were allowed was about 117° C. -about 133° C., and its temperature range (denoted by a "usable temperature range" in Tables 1-3 below) was 16 degrees.

Example 2

A peeling roller in Example 2 will be described mainly with respect to matters different from those of Example 1. In regard to the peeling roller of this example, a core bar was provided by fitting a shaft into a steel pipe member with a thickness of 3 mm, an outer diameter of 28 mm, and a width of 320 nm. Then, a polyimide tube with a thickness of 40 μm, an outer diameter of 40 mm, and a width of 320 nm was manufactured by a centrifugal coating method the same as in Example 1.

The polyimide tube and the core bar were set in a mold. Raw materials of silicone rubber were poured between the core bar and the polyimide tube and cured. As a result, a foamed silicone rubber roller having a polyimide layer formed as an organic polymer compound layer and a rubber elastic layer with a thickness of 6 mm (corresponding to the peeling member forming member 2' as shown in FIG. 7 or FIG. 9B) was obtained (with a rubber hardness of 40 degrees according to JIS K6050). The rubber used for the rubber elastic layer had a heat-conductivity of 0.23 W/mK.

Then, after the above-mentioned foamed silicone rubber roller was set instead of the peeling roller 2 of the image remover 1 of FIG. 1 the same as in Example 1, and the temperature of the heat and pressure roller was set at 120° C. for heating, image forming substances and releasing paper were manufactured the same as in Example 1 and the releasing paper on which a blue and solid image was formed by the above-mentioned imagio Neo C285 was caused to pass through at a rate of 40 mm/s, thereby obtaining a peeling roller on which a thermoplastic composition layer with a thickness of 32 μm was made of the image forming substances.

Then, as good separation of a reusable recording material from the surface of the peeling roller in the case where the preset temperature of the heat and pressure roller was changed and the temperature range in which the image forming substances could be removed from the reusable recording material completely were evaluated, it was impossible to remove an image completely at a temperature lower than about 108° C. and it was possible to separate the reusable recording material and the peeling roller in a temperature region higher than about 134° C., but a small amount of remaining image forming substances was observed, mainly on a solid image portion. Therefore, the range of the preset temperature of the heat and pressure roller in which both the separation between the reusable recording material and the peeling roller and removal of an image were allowed was about 108° C.- about 134° C. and its temperature range was 26 degrees.

Example 3

In Example 3, a tube with a diameter of 40 mm was manufactured of polyether sulfone for an organic polymer compound layer instead of the polyimide tube in Example 2. For the manufacturing of the tube, a commercially available polyether sulfone film with a thickness of 50 μm was prepared and bonded by means of an adhesive.

All of the manufacturing of image forming substances and a reusable recording material, formation of an image on the reusable recording material, manufacturing of a peeling roller, and a process for removing an image on the reusable recording material were conducted the same as in Example 2 except that the organic polymer compound layer made of the above-mentioned material was used. Then, the preset temperature of the heat and pressure roller was changed and the temperature range in which separation between the recording medium and the peeling roller was allowed and an image could be removed completely was evaluated the same as in Example 1. In this example, a temperature range of 22 degrees was obtained in which separation between the reusable recording material and the peeling roller was allowed and an image on the reusable recording material could be removed completely.

Furthermore, after running of an image remover was continued and a process for removing image forming substances on 2000 sheets was conducted the same as in Example 1, a process for removing image forming substances on the reusable recording material was conducted similarly, and as a result, an image removing property and separation between the reusable recording material and the peeling roller similar to those of initial running were obtained.

Example 4

In Example 4, a polyether sulfone tube with a thickness of 75 μm was prepared for an organic polymer compound layer wherein a commercially available film was bonded with an adhesive the same as in Example 3, instead of the polyether sulfone tube with a thickness of 50 μm in Example 3.

All of the manufacturing of image forming substances and a reusable recording material, formation of an image on the reusable recording material, manufacturing of a peeling roller, and a process for removing an image on the reusable recording material were conducted the same as in Example 3 except that the above-mentioned organic polymer compound layer with a different thickness was used. Then, the preset temperature of the heat and pressure roller was changed and the temperature range in which separation between the reusable recording material and the peeling roller was allowed and an image could be removed completely was evaluated the same as in Example 1. In this example, a temperature range of 17 degrees was obtained in which separation between the reusable recording material and the peeling roller was allowed and an image on the reusable recording material could be removed completely.

Example 5

In this example, a tube with a diameter of 40 mm was manufactured of polysulfone for an organic polymer compound layer instead of the polyimide tube in Example 2. For the manufacturing of the tube, a commercially available polysulfone film with a thickness of 50 μm was prepared and bonded by means of an adhesive.

All of the formation of image forming substances and a reusable recording material, creation of an image on the reusable recording material, manufacturing of a peeling roller, and a process for removing an image on the reusable recording material were conducted the same as in Example 2 except that the organic polymer compound layer made of the above-mentioned material was used. Then, the preset temperature of the heat and pressure roller was changed and the temperature range in which separation between the recording medium and the peeling roller was allowed and an image could be removed completely was evaluated the same as in Example 1. In this example, a temperature range of 15 degrees was obtained in which separation between the reusable recording material and the peeling roller was allowed and an image on the reusable recording material could be removed completely.

Example 6

In Example 6, a tube with a diameter of 40 mm was manufactured of polyetherimide for an organic polymer compound layer instead of the polyimide tube in Example 2. For the manufacturing of the tube, a commercially available polyetherimide film with a thickness of 50 μm was prepared and bonded by means of an adhesive.

All of the manufacturing of image forming substances and a reusable recording material, formation of an image on the reusable recording material, manufacturing of a peeling roller, and a process for removing an image on the reusable recording material were conducted the same as in Example 2 except that the organic polymer compound layer made of the above-mentioned material was used. Then, the preset temperature of the heat and pressure roller was changed and the temperature range in which separation between the reusable recording material and the peeling roller was allowed and an image could be removed completely was evaluated the same as in Example 1. In this example, a temperature range of 17 degrees was obtained in which separation between the recording medium and the peeling roller was allowed and an image on the reusable recording material could be removed completely.

Example 7

In Example 7, a tube with a diameter of 40 mm was manufactured of polyphenylene sulfide for an organic polymer compound layer instead of the polyimide tube in Example 2. For the manufacturing of the tube, a commercially available polyphenylene sulfide film with a thickness of 50 μm was prepared and bonded by means of an adhesive.

All of the manufacturing of image forming substances and a reusable recording material, formation of an image on the reusable recording material, manufacturing of a peeling roller, and a process for removing an image on the reusable recording material were conducted the same as in Example 2 except that the organic polymer compound layer made of the above-mentioned material was used. Then, the preset temperature of the heat and pressure roller was changed and the temperature range in which separation between the reusable recording material and the peeling roller was allowed and an image could be removed completely was evaluated the same as in Example 1. In this example, a temperature range of 10 degrees was obtained in which separation between the reusable recording material and the peeling roller was allowed and an image on the reusable recording material could be removed completely.

Example 8

In Example 8, a tube with a diameter of 40 mm was manufactured of polycarbonate for an organic polymer compound layer instead of the polyimide tube in Example 2. For the manufacturing of the tube, a commercially available polycarbonate film with a thickness of 50 μm was prepared and bonded by means of an adhesive.

All of the manufacturing of image forming substances and a reusable recording material, formation of an image on the reusable recording material, manufacturing of a peeling roller, and a process for removing an image on the reusable recording material were conducted the same as in Example 2 except that the organic polymer compound layer made of the above-mentioned material was used. Then, the preset temperature of the heat and pressure roller was changed and the temperature range in which separation between the reusable recording material and the peeling roller was allowed and an image could be removed completely was evaluated the same as in Example 1. In this example, a temperature range of 21 degrees was obtained in which separation between the reusable recording material and the peeling roller was allowed and an image on the reusable recording material could be removed completely.

Example 9

In Example 9, a polycarbonate tube with a thickness of 100 μm was prepared for an organic polymer compound layer wherein a commercially available polycarbonate film was bonded with an adhesive the same as in Example 8 instead of the polycarbonate tube with a thickness of 50 μm in Example 8. All of them were similar to those of Example 8 except that the polycarbonate tube with a thickness of 100 μm was used for an organic polymer compound layer.

Then, the preset temperature of the heat and pressure roller was changed and the temperature range in which separation between the reusable recording material and the peeling roller was allowed and an image could be removed completely was evaluated the same as in Example 1. In this example, a temperature range of 5 degrees was obtained in which separation between the reusable recording material and the peeling roller was allowed and an image on the reusable recording material could be removed completely.

Example 10

In Example 10, a tube with a diameter of 40 mm was manufactured of polyallylate for an organic polymer compound layer instead of the polyimide tube in Example 2. For the manufacturing of the tube, a commercially available polyallylate film with a thickness of 50 μm was prepared and bonded by means of an adhesive. All of them were similar to those of Example 2 except that the organic polymer compound layer made of the above-mentioned material was used.

Then, the preset temperature of the heat and pressure roller was changed and the temperature range in which separation between the reusable recording material and the peeling roller was allowed and an image could be removed completely was evaluated the same as in Example 1. In this example, a temperature range of 23 degrees was obtained in which separation between the reusable recording material and the peeling roller was allowed and an image on the reusable recording material could be removed completely.

Example 11

In Example 11, a tube with a diameter of 40 mm was manufactured of polyether ether ketone for an organic polymer compound layer, wherein a commercially available polyether ether ketone film with a thickness of 50 μm was prepared and bonded by means of an adhesive for the manufacturing of the tube instead of the polyimide tube in Example 2. All of them were similar to those of Example 2 except that the organic polymer compound layer made of the above-mentioned material was used.

Then, the preset temperature of the heat and pressure roller was changed and the temperature range in which separation between the reusable recording material and the peeling roller was allowed and an image could be removed completely was evaluated the same as in Example 1. In this example, a temperature range of 22 degrees was obtained in which separation between the reusable recording material and the peeling roller was allowed and an image on the reusable recording material could be removed completely.

Example 12

In Example 12, a polyether ether ketone tube with a thickness of 100 μm for an organic polymer compound layer was prepared wherein a commercially available polyether ether ketone film was bonded with an adhesive the same as in Example 11, instead of the polyether ether ketone tube with a thickness of 50 μm in Example 11. All of them were similar to those of Example 11 except that the organic polymer compound layer with a different thickness was used.

Then, the preset temperature of the heat and pressure roller was changed and the temperature range in which separation between the reusable recording material and the peeling roller was allowed and an image could be removed completely was evaluated the same as in Example 1. In this example, a temperature range of 7 degrees was obtained in which separation between the reusable recording material and the peeling roller was allowed and an image on the reusable recording material could be removed completely.

Example 13

In Example 13, a configuration similar to the peeling roller in Example 1 was provided except that a foamed silicone rubber with a hardness of 40 degrees (under the JIS S6050) was provided instead of an unfoamed silicone rubber used in Example 1. A rubber with a heat conductivity of 0.23 W/mK was used for the rubber of a rubber elasticity layer and the thickness of the rubber elasticity layer was 4 mm.

Then, the preset temperature of the heat and pressure roller was changed and the temperature range in which separation between the reusable recording material and the peeling roller was allowed and an image could be removed completely was evaluated the same as in Example 1. In this example, a temperature range of 28 degrees was obtained in which separation between the reusable recording material and the peeling roller was allowed and an image on the reusable recording material could be removed completely.

Example 14

In Example 14, a configuration similar to that of the peeling roller in Example 2 was provided except that a rubber elasticity layer with a thickness of 1 mm was provided and the outer diameter of a roller core bar was 38 mm instead of the rubber elasticity layer with a thickness of 6 mm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 3 degrees was obtained in which separation between the reusable recording material and the peeling roller was allowed and an image on the reusable recording material could be removed completely.

Example 15

In Example 15, a configuration similar to that of the peeling roller in Example 2 was provided except that a rubber elasticity layer with a thickness of 2 mm was provided and the outer diameter of a roller core bar was 36 mm instead of the rubber elasticity layer with a thickness of 6 mm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 15 degrees was obtained in which separation between the reusable recording material and the peeling roller was allowed and an image on the reusable recording material could be removed completely.

Example 16

In Example 16, a configuration similar to that of the peeling roller in Example 2 was provided except that a rubber elasticity layer with a thickness of 8 mm was provided and the outer diameter of a roller core bar was 24 mm instead of the rubber elasticity layer with a thickness of 6 mm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 22 degrees was obtained in which separation between the reusable recording material and the peeling roller was allowed and an image on the reusable recording material could be removed completely.

The following Table 1 shows the configurations of the peeling rollers and the results of the evaluations of the image removal (usable temperature ranges) in Examples 1 through 16 described above.

TABLE 1

| | ORGANIC POLYMER COMPOUND LAYER | | RUBBER ELASTICITY LAYER | | | | USABLE TEMPERATURE RANGE (DEGREES) |
|---|---|---|---|---|---|---|---|
| | MATERIAL | THICKNESS (mm) | PRESENCE OR ABSENCE OF FOAMING | HEAT CONDUCTIVITY (W/mK) | RUBBER THICKNESS (mm) | RUBBER HARDNESS (DEGREES) | |
| Example 1 | Polyimide | 40 | Non-foaming | 0.35 | 4 | 30 | 16 |
| Example 2 | Polyimide | 40 | Foaming | 0.23 | 6 | 40 | 26 |
| Example 3 | Polyether sulfone | 50 | Foaming | 0.23 | 6 | 40 | 22 |
| Example 4 | Polyether sulfone | 75 | Foaming | 0.23 | 6 | 40 | 17 |
| Example 5 | Polysulfone | 50 | Foaming | 0.23 | 6 | 40 | 15 |
| Example 6 | Polyetherimide | 50 | Foaming | 0.23 | 6 | 40 | 17 |
| Example 7 | Polyphenylene sulfide | 50 | Foaming | 0.23 | 6 | 40 | 10 |
| Example 8 | Polycarbonate | 50 | Foaming | 0.23 | 6 | 40 | 21 |
| Example 9 | Polycarbonate | 100 | Foaming | 0.23 | 6 | 40 | 5 |
| Example 10 | Polyallylate | 50 | Foaming | 0.23 | 6 | 40 | 23 |
| Example 11 | Polyether ether ketone | 50 | Foaming | 0.23 | 6 | 40 | 22 |
| Example 12 | Polyether ether ketone | 100 | Foaming | 0.23 | 4 | 40 | 7 |
| Example 13 | Polyimide | 40 | Foaming | 0.23 | 4 | 40 | 28 |
| Example 14 | Polyimide | 40 | Foaming | 0.23 | 1 | 40 | 3 |
| Example 15 | Polyimide | 40 | Foaming | 0.23 | 2 | 40 | 15 |
| Example 16 | Polyimide | 40 | Foaming | 0.23 | 8 | 40 | 22 |

Example 17

In Example 17, a configuration similar to that of the peeling roller in Example 2 was provided except that a rubber elasticity layer with a thickness of 10 mm was provided and the outer diameter of a roller core bar was 20 mm instead of the rubber elasticity layer with a thickness of 6 mm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 18 degrees was obtained in which separation between the reusable recording material and the peeling roller was allowed and an image on the reusable recording material could be removed completely.

Example 18

In Example 18, a configuration similar to that of the peeling roller in Example 2 was provided except that a rubber elasticity layer with a thickness of 12 mm was provided and the outer diameter of a roller core bar was 16 mm instead of the rubber elasticity layer with a thickness of 6 mm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 8 degrees was obtained in which separation between the reusable recording material and the peeling roller was allowed and an image on the reusable recording material could be removed completely.

Example 19

In Example 19, a configuration similar to that of the peeling roller in Example 2 was provided except that a polyimide tube with a thickness of 10 μm was used instead of the polyimide tube with a thickness of 40 μm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 35 degrees was obtained in which separation between the reusable recording material and the peeling roller was allowed and an image on the reusable recording material could be removed completely.

Example 20

In Example 20, a configuration similar to that of the peeling roller in Example 2 was provided except that a polyimide tube with a thickness of 20 μm was used instead of the polyimide tube with a thickness of 40 μm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 34 degrees was obtained in which separation between the reusable recording material and the peeling roller was allowed and an image on the reusable recording material could be removed completely.

Example 21

In Example 21, a configuration similar to that of the peeling roller in Example 2 was provided except that a polyimide tube with a thickness of 60 μm was used instead of the polyimide tube with a thickness of 40 μm in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 20 degrees was obtained in which separation between the reusable recording material and the peeling roller was allowed and an image on the reusable recording material could be removed completely.

Example 22

In Example 22, a configuration similar to that of the peeling roller in Example 2 was provided except that a polyimide tube with a thickness of 80 μm was used instead of the polyimide tube with a thickness of 40 μm used in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 15 degrees was obtained in which separation between the reusable recording material and the peeling roller was allowed and an image on the reusable recording material could be removed completely.

Example 23

In Example 23, a configuration similar to that of the peeling roller in Example 2 was provided except that a polyimide tube with a thickness of 100 μm was used instead of the polyimide tube with a thickness of 40 μm used in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 5 degrees was obtained in which separation between the reusable recording material and the peeling roller was allowed and an image on the reusable recording material could be removed completely.

Example 24

In Example 24, a configuration similar to that of the peeling roller in Example 2 was provided except that a polyimide tube with a thickness of 120 was used instead of the polyimide tube with a thickness of 40 μm used in Example 2.

Then, the preset temperature of the heat and pressure roller was changed and the temperature range in which separation between the reusable recording material and the peeling roller was allowed and an image could be removed completely was evaluated the same as in Example 1. In this example, a temperature range of 6 degrees was obtained in which separation between the reusable recording material and the peeling roller was allowed and an image on the reusable recording material could be removed completely.

Example 25

In Example 25, a configuration similar to that of the peeling roller in Example 1 was provided except that a polyimide tube with a diameter of 40 mm and a thickness of 40 μm was used for an organic polymer compound layer and an unfoamed silicone rubber with a rubber hardness of 20 degrees (under the JIS K6301A), a heat conductivity of 0.45 W/mK and a thickness of 4 mm was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 14 degrees was obtained in which separation between the reusable recording material and the peeling roller was allowed and an image on the reusable recording material could be removed completely.

Example 26

In Example 26, a configuration similar to that of the peeling roller in Example 1 was provided except that a polyimide tube with a diameter of 40 mm and a thickness of 40 μm was used for an organic polymer compound layer and an unfoamed silicone rubber with a rubber hardness of 60 degrees (under the JIS K6301A), a heat conductivity of 0.65 W/mK and a thickness of 4 mm was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 7 degrees was obtained in which separation between the reusable recording material and the peeling roller was allowed and an image on the reusable recording material could be removed completely.

Example 27

In Example 27, a configuration similar to that of the peeling roller in Example 1 was provided except that a polyimide tube with a diameter of 40 mm and a thickness of 40 μm was used for an organic polymer compound layer and an unfoamed silicone rubber with a rubber hardness of 60 degrees (under the JIS K6301A), a heat conductivity of 0.73 W/mK and a thickness of 2 mm was provided instead on the silicone rubber in Example 1.

The preset temperature of the heat and pressure roller was changed and the temperature range in which separation between the reusable recording material and the peeling roller was allowed and an image could be removed completely was evaluated the same as in Example 1. In this example, a temperature range of 2 degrees was obtained in which separation between the reusable recording material and the peeling roller was allowed and an image on the reusable recording material could be removed completely.

Example 28

In Example 28, a configuration similar to that of the peeling roller in Example 1 was provided except that a polyimide tube with a diameter of 40 mm and a thickness of 40 μm was used for an organic polymer compound layer and a foamed silicone rubber with a rubber hardness of 20 degrees (under the JIS K6050), a heat conductivity of 0.15 W/mK and a thickness of 4 mm was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 25 degrees was obtained in which separation between the reusable recording material and the peeling roller was allowed and an image on the reusable recording material could be removed completely.

Example 29

In Example 29, a configuration similar to that of the peeling roller in Example 1 was provided except that a polyimide tube with a diameter of 40 mm and a thickness of 40 μm was used for an organic polymer compound layer and a foamed silicone rubber with a rubber hardness of 40 degrees (under the JIS K6050), a heat conductivity of 0.32 W/mK and a thickness of 4 mm was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 19 degrees was obtained in which separation between the reusable recording material and the peeling roller was allowed and an image on the reusable recording material could be removed completely.

Example 30

In Example 30, a configuration similar to that of the peeling roller in Example 1 was provided except that a polyimide tube with a diameter of 40 mm and a thickness of 40 μm was used for an organic polymer compound layer and further a foamed silicone rubber with a rubber hardness of 40 degrees (under the JIS K6050), a heat conductivity of 0.33 W/mK and a thickness of 4 mm was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 17 degrees was obtained in which separation between the reusable recording material and the peeling roller was allowed and an image on the reusable recording material could be removed completely.

Example 31

In Example 31, a configuration similar to that of the peeling roller in Example 1 was provided except that a polyimide tube with a diameter of 40 mm and a thickness of 40 μm was used for an organic polymer compound layer and a foamed silicone rubber with a rubber hardness of 60 degrees (under the JIS K6050) and a heat conductivity of 0.40 W/mK was provided instead on the silicone rubber in Example 1.

Then, the preset temperature of the heat and pressure roller was changed and the temperature range in which separation between the reusable recording material and the peeling roller was allowed and an image could be removed completely was evaluated the same as in Example 1. In this example, a temperature range of 14 degrees was obtained in which separation between the reusable recording material and the peeling roller was allowed and an image on the reusable recording material could be removed completely.

The following Table 2 shows the configurations of the peeling rollers and the results of the evaluations of the image removal (usable temperature ranges) in Examples 17 through 31 described above.

TABLE 2

| | ORGANIC POLYMER COMPOUND LAYER | | RUBBER ELASTICITY LAYER | | | | USABLE TEMPERATURE RANGE (DEGREES) |
|---|---|---|---|---|---|---|---|
| | MATERIAL | THICKNESS (mm) | PRESENCE OR ABSENCE OF FOAMING | HEAT CONDUCTIVITY (W/mK) | RUBBER THICKNESS (mm) | RUBBER HARDNESS (DEGREES) | |
| Example 17 | Polyimide | 40 | Foaming | 0.23 | 10 | 40 | 18 |
| Example 18 | Polyimide | 40 | Foaming | 0.23 | 12 | 40 | 8 |
| Example 19 | Polyimide | 10 | Foaming | 0.23 | 6 | 40 | 35 |
| Example 20 | Polyimide | 20 | Foaming | 0.23 | 6 | 40 | 34 |
| Example 21 | Polyimide | 60 | Foaming | 0.23 | 6 | 40 | 20 |
| Example 22 | Polyimide | 80 | Foaming | 0.23 | 6 | 40 | 15 |
| Example 23 | Polyimide | 100 | Foaming | 0.23 | 6 | 40 | 5 |
| Example 24 | Polyimide | 120 | Foaming | 0.23 | 6 | 40 | 2 |
| Example 25 | Polyimide | 40 | Non-foaming | 0.45 | 4 | 20 | 14 |
| Example 26 | Polyimide | 40 | Non-foaming | 0.65 | 4 | 60 | 7 |
| Example 27 | Polyimide | 40 | Non-foaming | 0.73 | 4 | 60 | 2 |
| Example 28 | Polyimide | 40 | Foaming | 0.15 | 4 | 20 | 25 |
| Example 29 | Polyimide | 40 | Foaming | 0.32 | 4 | 40 | 19 |
| Example 30 | Polyimide | 40 | Foaming | 0.33 | 4 | 40 | 17 |
| Example 31 | Polyimide | 40 | Foaming | 0.40 | 4 | 60 | 14 |

Next, comparative examples for each of the above-mentioned examples will be described below.

Comparative Example 1

A shaft was fitted into a steel pipe member with a thickness of 3 mm, an outer diameter of 39 mm and a width of 320 mm to provide a roller-shaped core bar. Then, an unfoamed silicone rubber layer with a thickness of 0.5 mm, a rubber hardness of 30 degrees (under the JIS K6301A) and a heat conductivity of 0.35 W/mK was provided on the core bar by using a rubber material identical to that used in Example 1.

Then, after a roller provided with the above-mentioned silicone rubber elasticity layer was set instead of the peeling roller 2 of the image remover 1 of FIG. 1 and the temperature of the heat and pressure roller was set at 130° C. for heating the same as in Example 1, image forming substances and releasing paper were manufactured and the releasing paper on which a blue and solid image was formed by the above-mentioned imagio Neo C285 was caused to pass through at a rate of 10 mm/s the same as in Example 1, whereby the solid image on the releasing paper was transferred onto the silicone rubber roller. Subsequently, releasing paper on which four solid images were formed was further caused to pass through and the solid images were all transferred onto the above-mentioned silicone rubber roller.

Thus, a peeling roller provided with a thermoplastic composition layer with a thickness of 32 μm which was formed of the image forming substances was obtained the same as in Example 1 except that no organic polymer compound layer was provided and the thermoplastic composition layer was directly provided on a rubber elasticity layer. Furthermore, when manufacturing of a reusable recording material and image formation on the reusable recording material were conducted by using the peeling roller the same as in Example 1 and the removal property and separation property of an image were evaluated, the reusable recording material remained attached to the peeling roller and could not be separated by a separation member.

Furthermore, because the reusable recording material could not be separated at a predetermined separation position, the rotation of the peeling roller was stopped by means of switching off at a time when the leading edge of the reusable recording material had passed the separation position and the reusable recording material was forcibly separated from the stopped peeling roller or roller member by a metal spatula or hand method but most of the image on the reusable recording material remained and had not been transferred onto the peeling roller.

The same as in Example 1, the separation property of the reusable recording material from the surface of the peeling roller and the temperature range in which the image forming substances on the reusable recording material could be removed completely were also evaluated at a time when the preset temperature of the heat and pressure roller was changed in Comparative Example 1, and as a result, the image had not been removed at a temperature lower than about 115° C. although separation between the reusable recording material and the peeling roller was allowed. On the other hand, when the preset temperature of the heat and pressure roller was 116° C. or higher, separation between the reusable recording material and the peeling roller was not allowed. That is, no temperature range in which separation between the reusable recording material and the peeling roller was allowed and an image could be removed completely was obtained in Comparative Example 1.

Comparative Example 2

A shaft was fitted into a steel pipe member with a thickness of 3 mm, an outer diameter of 32 mm and a width of 320 mm to provide a roller-shaped core bar. Then, an unfoamed silicone rubber layer with a thickness of 4 mm, a rubber hardness of 30 degrees under the JIS K6301A and a heat conductivity of 0.35 W/mK was provided on the core bar by using a rubber material identical to that used in Example 1.

Then, after a silicone rubber roller provided with the above-mentioned silicone rubber elasticity layer was set instead of the peeling roller 2 of the image remover 1 of FIG. 1 and the temperature of the heat and pressure roller was set at 120° C. for heating the same as in Example 1, image forming substances and releasing paper were manufactured and the releasing paper on which a blue and solid image was formed by the above-mentioned imagio Neo C285 was passed at a rate of 10 mm/s the same as in Example 1, whereby the solid image on the releasing paper was transferred onto the silicone rubber roller. Subsequently, releasing paper on which four solid images were formed was further caused to pass through and the solid images were all transferred onto the above-mentioned silicone rubber roller.

Thus, a peeling roller provided with a thermoplastic composition layer with a thickness of 32 μm which was formed of the image forming substances was obtained the same as in Example 1 except that no organic polymer compound layer was provided and the thermoplastic composition layer was directly provided on a rubber elasticity layer. Furthermore, when manufacturing of a reusable recording material and image formation on the reusable recording material were conducted by using the peeling roller the same as in Example 1 except that the preset temperature of the heat and pressure roller was set at 123° C. and the removal property and separation property of an image were evaluated at a processing speed of 40 mm/s. In Comparative Example 2, the reusable recording material attaching to the peeling roller could be separated by a separation member but a stripe-like residual image remained in the directions perpendicular to the directions of conveyance of the reusable recording material and an image on the reusable recording material could not be removed completely.

In Comparative Example 2, when the conducted image removing process was observed, it was found that the reusable recording material having passed through the nip between the heat and pressure roller and the peeling roller was detached from the surface of the peeling roller as shown in FIG. 3 until the separation position was reached. The period of the detachment of the reusable recording material from the peeling roller surface generally corresponded to that of the above-mentioned stripe-like residual image. Hence, it was considered that the generation of the stripe-like residual image was caused by the detachment of the reusable recording material.

The same as in Example 1, when the preset temperature of the heat and pressure roller was changed, the temperature range in which separation between the reusable recording material and the peeling roller was allowed and an image could be removed completely was also evaluated in Comparative Example 2. As a result, when the surface temperature of the heat and pressure roller was lower than 124° C., the above-mentioned stripe-like residual image was observed although separation between the reusable recording material and the peeling roller was allowed. On the other hand, when the preset temperature of the heat and pressure roller was higher than 124° C., the separation was not allowed. That is, no temperature range in which separation between the reusable recording material and the peeling roller was allowed and an image could be removed completely was obtained in Comparative Example 2.

Comparative Example 3

The transfer property of image forming substances from a reusable recording material was evaluated the same as in Example 1, except that a process for transferring the image forming substances from releasing paper onto an organic polymer compound layer was omitted and no thermoplastic composition layer was provided in Example 1.

That is, in Comparative Example 3, removal of an image on the reusable recording material was conducted on the same conditions as those of Example 1 while a peeling roller provided with no thermoplastic composition layer was used whose top surface was an organic polymer compound layer. As a result, solid image portions and character images had been removed but low density images particularly remained on the reusable recording material among the gradation images. Furthermore, toner scattered on the periphery of the image was also observed on the reusable recording material subjected to the image removal.

The same as in Example 1, when the preset temperature of the heat and pressure roller was changed, the temperature range in which separation between the reusable recording material and the peeling roller was allowed and an image could be removed completely was also evaluated in Comparative Example 3. As a result, when the temperature of the heat and pressure roller was lower than 115° C., the solid image on the reusable recording material was not removed although separation between the reusable recording material and the peeling roller was allowed. On the other hand, when the temperature of the heat and pressure roller was in a range higher than 115° C. and 140° C. or lower, low density images remained on the reusable recording material although the separation and removal of the solid image were allowed. In addition, when a temperature higher than 140° C. was set, the separation was not allowed. That is, no temperature range in which separation between the reusable recording material and the peeling roller was allowed and an image could be removed completely was obtained in Comparative Example 3.

Comparative Example 4

In Comparative Example 4, a shaft was fitted into a steel pipe member with a thickness of 3 mm, an outer diameter of 40 mm and a width of 320 mm to provide a roller-shaped core bar. A silicone-based adhesive was applied on the core bar so as to prepare a peeling roller that did not have the rubber elasticity layer covered with the polyimide tube (organic polymer compound layer) used in Example 1.

Then, a heat and pressure roller having a surface covered with a silicone rubber elasticity layer with a thickness of 4 mm and a rubber hardness of 30 degrees (according to JIS K6301A) and an organic polymer compound having low surface energy were set instead of the heat and pressure roller with its surface covered with the organic polymer compound having low surface energy in the image remover 1 of FIG. 1. A peeling roller which was not provided with a rubber elasticity layer on the above-mentioned core bar but was directly provided with an organic polymer compound layer was also set instead of the peeling roller of the image remover of FIG. 1. Then, the conditions of the image remover were similar to those of Example 1 except that the processing speed was 5 mm/s, releasing paper on which a blue and solid image was formed by imagio Neo C285 was caused to pass through the same as in Example 1, so that an image forming substance layer made of a thermoplastic composition and having a thickness of 32 μm was formed on the peeling roller having no rubber elasticity layer.

When manufacturing of a reusable recording material and image formation on the reusable recording material were conduced and the removal property and separation property of an image were evaluated the same as in Example 1 except that the peeling roller manufactured as described above was used and the heat and pressure roller having a rubber elasticity layer was used, the reusable recording material had passed through a separation member without being removed from a thermoplastic composition layer of the peeling roller after having passed through the nip provided between the heat and pressure roller and the peeling roller, and it was difficult to separate the reusable recording material from the peeling roller.

The same as in Example 1, when the preset temperature of the heat and pressure roller was changed, the temperature range in which separation between the reusable recording material and the peeling roller was allowed and an image could be removed completely was also evaluated in Comparative Example 4. As a result, when the temperature of the heat and pressure roller was lower than 110° C., a solid image on the reusable recording material was not removed although separation between the reusable recording material and the peeling roller was allowed. On the other hand, when the temperature of the heat and pressure roller was set at a temperature higher than 110° C., the separation was not allowed. That is, no temperature range in which separation between the reusable recording material and the peeling roller was allowed and an image could be removed completely was obtained in Comparative Example 4.

The following Table 3 shows the configurations of the peeling rollers and the results of the evaluations of the image removal (usable temperature ranges) in Comparative Examples 1 through 5 described above.

TABLE 3

| | CONFIGURATION OF PEELING ROLLER | RUBBER ELASTICITY LAYER | | | | USABLE |
|---|---|---|---|---|---|---|
| | | PRESENCE OR ABSENCE OF FOAMING | HEAT CONDUCTIVITY (W/mK) | RUBBER THICKNESS (mm) | RUBBER HARDNESS (DEGREES) | TEMPERATURE RANGE (DEGREES) |
| Comparative Example 1 | No organic polymer compound layer | Non-foaming | 0.35 | 0.5 | 30 | 0 |
| Comparative Example 2 | No organic polymer compound layer | Non-foaming | 0.35 | 4 | 30 | 0 |
| Comparative Example 3 | No thermoplastic composition layer | Non-foaming | 0.35 | 4 | 30 | 0 |
| Comparative Example 4 | No rubber elasticity layer | — | — | — | — | 0 |
| Comparative Example 5 | No thermoplastic composition layer | Foaming | 0.23 | 6 | 40 | 0 |

Comparative Example 5

In Comparative Example 5, the transfer property of image forming substances from a reusable recording material was evaluated the same as in Example 2, except that a process for transferring the image forming substances from releasing paper onto an organic polymer compound layer was omitted and no thermoplastic composition layer was provided in Example 2.

That is, in Comparative Example 5, removal of an image on the reusable recording material was conducted on the same conditions as those of Example 2 while a peeling roller provided with no thermoplastic composition layer was used whose surface was an organic polymer compound layer.

The same as in Example 1, when the preset temperature of the heat and pressure roller was changed, the temperature range in which separation between the reusable recording material and the peeling roller was allowed and an image could be removed completely was also evaluated in Comparative Example 5. As a result, when the surface temperature of the heat and pressure roller was lower than 116° C., the solid image on the reusable recording material was not removed although separation between the reusable recording material and the peeling roller was allowed. On the other hand, when the surface temperature of the heat and pressure roller was in a range higher than 116° C. and 148° C. or lower, low density images remained on the reusable recording material although the separation and removal of the solid image were allowed. In addition, when a temperature higher than 148° C. was set, the separation was not allowed. That is, no temperature range in which separation between the reusable recording material and the peeling roller was allowed and an image could be removed completely was obtained in Comparative Example 5.

Thus, when the peeling roller in each of the above-described examples according to the present invention was used, the temperature range in which separation between the reusable recoding medium and the peeling roller was allowed and an image on the reusable recording material could be removed completely could be obtained. On the other hand, when the peeling roller in each of the above-described comparative examples was used, the temperature range in which separation between the reusable recoding medium and the peeling roller was allowed and an image on the reusable recording material could be removed completely could not be obtained.

A peeling member, image remover, image removing method, and image forming and removing system according to the present invention may not only be applied to a technical field such that an image is formed by a commonly used electrophotographic process for forming an electrostatic latent image on a photoconductor containing a photoconductive material, then developing it with a dry toner, and transferring a toner image onto a recording medium but could also be applied to a technical field such that an image is formed by an electrophotographic process or electrophotographic apparatus based on an electrostatic recording method, a toner jet recording method, an ion flow recording method or the like without using a photoconductor.

Furthermore, the present invention is not necessarily limited to a technical field such that an image is formed by an electrophotographic process and could also be applied to a technical field such that an image is formed by a magnetic recording process for forming an image using a thermoplastic image forming substance, a thermal transfer process or an ink jet method using a hot-melt solid ink.

A peeling member according to one embodiment of the present invention includes an organic polymer compound layer on a rubber elasticity layer provided on a base body, the organic polymer compound layer presenting no plasticity at a heating temperature for peeling off and removing an image formed of a thermoplastic image forming substance on recording material and having a Young's modulus of 400 MPa to 6000 MPa at normal temperature; and a thermoplastic composition layer including thermoplastic resin, the thermoplastic composition layer being formed on the surface of the organic polymer compound layer and serving as an outermost surface layer to present adhesion to the thermoplastic image forming substance. Accordingly, by performing image removal with an image remover or an image forming and removing system having this peeling member, the outermost thermoplastic composition layer of the peeling member is heated and softened so as to suitably adhere to the image on the surface of the recording material.

Therefore, even if the image is "high" or there is large unevenness on the surface of the recording material as in the case of a color image formed by superposing image forming substances of multiple colors on the recording material, the thermoplastic composition layer satisfactorily comes into contact with the entire uneven image surface and the thermoplastic image forming substance adhering to the background, so that it is possible to ensure removal of the thermoplastic image forming substance on the recording material.

If a peeling member having the thermoplastic composition layer provided directly on the rubber elasticity layer is employed, the recording material periodically rises from the peeling member immediately after passing through the heat and pressure nip of the image remover. The cohesion failure occurs where the recording material is separated (detached) from the peeling member immediately after passing through the heat and pressure nip. Therefore, a periodic residual image is generated on the recording material subjected to the image removal processing. However, by providing the organic polymer compound layer having a Young's modulus substantially higher than that of the rubber elasticity layer and having flexibility between the rubber elasticity layer and the thermoplastic composition layer as in an embodiment of the present invention, the above-described rising is prevented from occurring, so that it is possible to completely remove the image.

Further, with the organic polymer compound layer, it is possible to prevent a component of the thermoplastic composition layer formed on the surface of the organic polymer compound layer from being transferred to the rubber elasticity layer. Therefore, even if the same peeling member is used for a long term, there is little change in the physical properties of the rubber elasticity layer, such as the modulus of elasticity. Accordingly, it is possible to repeatedly remove the image formed on the recording material stably and completely.

Further, according to one embodiment of the present invention, the rubber elasticity layer employed may have a relatively large thickness. Therefore, it is possible to ensure a sufficiently large nip width even in the case of using a rigid body such as metal as the pressure member opposed to the peeling member.

Further, the heating part may be provided inside the pressure member so that the pressure member may be used as a heat and pressure member. This facilitates heat conduction to the recording material in the nip, thus making it possible to perform image removal at high speed. Further, since the rubber elasticity layer and the organic polymer compound layer are extremely lower in thermal conductivity than metal material, heat is less easily conductible to the base body side across the rubber elasticity layer, so that the temperature increases only at and near the surface of the peeling member inside the nip formed by the peeling member and the heat and pressure member. That is, since the temperature increases only where the heat capacity is low, the temperature of the peeling member and the thermoplastic image forming substance adhering to the peeling member is easily reducible in a process after passing through the nip.

Therefore, when the recording material is separated from the peeling member, the temperature of the thermoplastic image forming substance on the recording material and the thermoplastic composition layer of the peeling member has been rapidly reduced, so that it is possible to prevent cohesion failure from occurring in the thermoplastic image forming substance on the recording material and the thermoplastic composition layer of the peeling member to cause the thermoplastic image forming substance to remain on the recording material or transfer in reverse the thermoplastic composition layer of the peeling member to the recording material.

Further, if the peeling member is provided with a relatively thick rubber elasticity layer, and a roller member having high rigidity, such as a metal roller member, is employed as the pressure member opposed to the peeling member to form the nip, the recording material that has passed through the nip is disposed to be conveyed along the peripheral surface of the highly rigid roller member (pressure member). Because of this disposition, the recording material conveyed for image removal acts to be apart from the peeling member after passing through the nip, thus resulting in satisfactory separation of the recording material and the peeling member.

Further, according to a method of manufacturing a peeling member according to one embodiment of the present invention, the peeling member can be manufactured with ease at low cost.

The present invention is not limited to the specifically disclosed embodiments, and variations and modifications may be made without departing from the scope of the present invention.

The present application is based on Japanese Priority Patent Applications No. 2007-240081, filed on Sep. 14, 2007, and No. 2008-124531, filed on May 12, 2008, the entire contents of which are incorporated herein by reference.

The invention claimed is:

1. A peeling member to be used in an image remover configured to peel off and remove an image by thermal transfer from a recording material on which the image is formed of a thermoplastic image forming substance, the peeling member comprising:

a base body;

a rubber elasticity layer provided on the base body, the rubber elasticity layer being formed of a material having rubber elasticity;

an organic polymer compound layer provided on the rubber elasticity layer, the organic polymer compound layer presenting no plasticity at a heating temperature that is used by the peeling member for peeling off and removing the image on the recording material by thermal transfer and having a Young's modulus of 400 MPa to 6000 MPa ; and a thermoplastic composition layer formed on a surface of the organic polymer compound layer so as to serve as an outermost surface layer presenting adhesion to the thermoplastic image forming substance, wherein the rubber elasticity layer has a thickness of 2 mm to 10 mm.

2. The peeling member as claimed in claim 1, wherein the material having the rubber elasticity has a thermal conductivity less than or equal to 0.70 W/mK.

3. The peeling member as claimed in claim 1, wherein the material having the rubber elasticity is silicone rubber.

4. The peeling member as claimed in claim 3, wherein the silicone rubber is foamed.

5. The peeling member as claimed in claim 1, wherein the organic polymer compound layer prevents a component substance of the thermoplastic composition layer from penetrating through the organic polymer compound layer.

6. The peeling member as claimed in claim 1, wherein the organic polymer compound layer has a thickness of 2 μm to 90 μm.

7. The peeling member as claimed in claim 1, wherein the organic polymer compound layer comprises a material selected from the group consisting of polyether sulfone, polysulfone, polyetherimide, polyphenylene sulfide, polycarbonate, polyallylate, polyimide, and polyether ether ketone.

8. The peeling member as claimed in claim 1, wherein the thermoplastic composition layer has a softening temperature less than or equal to 150° C.

9. The peeling member as claimed in claim 1, wherein the thermoplastic composition layer has a thickness of 5 μm to 100 μm.

10. The peeling member as claimed in claim 1, wherein the thermoplastic composition layer includes a release agent.

11. The peeling member as claimed in claim 10, wherein:

the release agent is wax, and the wax included in the thermoplastic composition layer is more than or equal to 1 wt % of the total weight of the thermoplastic composition layer.

* * * * *